US009653013B2

(12) United States Patent
Miyata et al.

(10) Patent No.: US 9,653,013 B2
(45) Date of Patent: May 16, 2017

(54) LIQUID CRYSTAL DISPLAY DEVICE, DATA LINE DRIVE CIRCUIT, AND DRIVE METHOD FOR LIQUID CRYSTAL DISPLAY DEVICE

(71) Applicant: Sharp Kabushiki Kaisha, Osaka-shi, Osaka (JP)

(72) Inventors: Hidekazu Miyata, Osaka (JP); Tadao Morishita, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 40 days.

(21) Appl. No.: 14/399,073

(22) PCT Filed: May 21, 2013

(86) PCT No.: PCT/JP2013/064075
§ 371 (c)(1),
(2) Date: Nov. 5, 2014

(87) PCT Pub. No.: WO2013/176126
PCT Pub. Date: Nov. 28, 2013

(65) Prior Publication Data

US 2015/0138249 A1 May 21, 2015

(30) Foreign Application Priority Data

May 24, 2012 (JP) ..... 2012-118367

(51) Int. Cl.
*G09G 3/20* (2006.01)
*G09G 3/36* (2006.01)

(52) U.S. Cl.
CPC ..... *G09G 3/2007* (2013.01); *G09G 3/3614* (2013.01); *G09G 3/3648* (2013.01);
(Continued)

(58) Field of Classification Search
CPC ... G09G 2300/0823; G09G 2300/0828; G09G 2310/0248; G09G 2310/027;
(Continued)

(56) References Cited

U.S. PATENT DOCUMENTS 6,552,705 B1 * 4/2003 Hirota ..... G09G 3/3648 345/103
7,015,903 B2 * 3/2006 Lee ..... G09G 3/3648 345/212
(Continued)

FOREIGN PATENT DOCUMENTS

JP 2001-202066 A 7/2001
JP 2002182619 A 6/2002
(Continued)

OTHER PUBLICATIONS

International Search Report PCT/ISA/210 for International Application No. PCT/JP2013/064075 Dated Jul. 30, 2013.
(Continued)

*Primary Examiner* — Tony Davis
(74) *Attorney, Agent, or Firm* — Harness, Dickey & Pierce, P.L.C.

(57) ABSTRACT

Provided is a liquid crystal display device that can suppress, more than the prior art, lowering of display quality when low-frequency drive is being carried out. The liquid crystal display device is operated in a low frequency drive mode. A source driver applies a gradation voltage during write periods and an idle period voltage during an idle period to each source line. The value of the idle period voltage is, for example, an average value of a maximum gradation positive voltage, a maximum gradation negative voltage, a minimum gradation positive voltage, and a minimum gradation negative voltage. By making the voltage for each source line during the idle period be the idle period voltage, potential
(Continued)

variations in the source lines when switching from the write periods to the idle period are smaller than the prior art.

8 Claims, 10 Drawing Sheets

(52) U.S. Cl.
CPC ..... *G09G 3/3674* (2013.01); *G09G 3/3685* (2013.01); *G09G 2300/0823* (2013.01); *G09G 2300/0828* (2013.01); *G09G 2310/027* (2013.01); *G09G 2310/0248* (2013.01)

(58) Field of Classification Search
CPC .. G09G 3/2007; G09G 3/3614; G09G 3/3648; G09G 3/3674; G09G 3/3685
USPC ..... 345/94, 98, 204, 211, 690
See application file for complete search history.

(56) References Cited

U.S. PATENT DOCUMENTS

| | | | | |
|---|---|---|---|---|
| 7,042,431 | B1 | 5/2006 | Washio et al. | |
| 9,153,186 | B2 * | 10/2015 | Al-Dahle | G09G 3/3648 |
| 2002/0093473 | A1 | 7/2002 | Tanaka et al. | |
| 2002/0180673 | A1 | 12/2002 | Tsuda et al. | |
| 2003/0058232 | A1 | 3/2003 | Washio et al. | |
| 2003/0080951 | A1 | 5/2003 | Fujiwara et al. | |
| 2004/0113879 | A1 | 6/2004 | Sekiguchi et al. | |
| 2005/0140632 | A1 | 6/2005 | Tsuda et al. | |
| 2006/0103620 | A1 * | 5/2006 | Joo | G09G 3/3611 345/98 |
| 2007/0057891 | A1 * | 3/2007 | Cheng | G09G 3/3648 345/94 |
| 2008/0055218 | A1 | 3/2008 | Tsuda et al. | |
| 2011/0157252 | A1 | 6/2011 | Yamazaki et al. | |
| 2012/0105414 | A1 * | 5/2012 | Yu | G09G 3/3674 345/211 |
| 2013/0106824 | A1 * | 5/2013 | Yamauchi | G09G 3/3258 345/211 |

FOREIGN PATENT DOCUMENTS

| | | | |
|---|---|---|---|
| JP | 2002-207462 | A | 7/2002 |
| JP | 2002-278523 | A | 9/2002 |
| JP | 2003131632 | A | 5/2003 |
| JP | 2003173175 | A | 6/2003 |
| JP | 2004206075 | A | 7/2004 |
| JP | 2006139315 | A | 6/2006 |
| JP | 2011-154357 | A | 8/2011 |
| WO | WO-2012008216 | A1 | 1/2012 |

OTHER PUBLICATIONS

Written Opinion of the International Searching Authority PCT/ISA/237 for International Application No. PCT/JP2013/064075 Dated Jul. 30, 2013.

* cited by examiner

LIQUID CRYSTAL DISPLAY DEVICE, DATA LINE DRIVE CIRCUIT, AND DRIVE METHOD FOR LIQUID CRYSTAL DISPLAY DEVICE

TECHNICAL FIELD

The present invention relates to a liquid crystal display device, particularly to a liquid crystal display device that performs a low frequency drive, a data line drive circuit that is used in the liquid crystal display device, and a drive method for the liquid crystal display device.

BACKGROUND ART

In the past, in a display apparatus such as a liquid crystal display device, reduction in power consumption has been demanded. Accordingly, for example, in PTL 1, it is disclosed a drive method for a display apparatus in which after a writing period where gate lines (scan lines) of the liquid crystal display device are sequentially selected, and writing of a voltage which is applied through a source line (hereinafter, there is a case of being referred to as "voltage of source line.") to a pixel electrode is performed, a suspension period where all of the gate lines are in a non-scan state is arranged. The suspension period is set to be longer than the writing period, and the sum of the suspension period and the writing period is set to be 1 frame period (referred to as 1 vertical period). In the suspension period, for example, it can be set such that a signal for control and the like are not given to a gate driver and/or a source driver. Hereby, since an operation of the gate driver and/or the source driver can be suspended, it is possible to achieve the reduction in power consumption. The drive method as described in PTL 1, which is performed by providing the suspension period after the writing period, is referred to as "low frequency drive," for example.

CITATION LIST

Patent Literature

PTL 1: Japanese Unexamined Patent Application Publication No. 2003-131632

SUMMARY OF INVENTION

Technical Problem

Incidentally, it is known that parasitic capacitance is formed between the pixel electrode and the source line. If a potential variation is generated in the source line, the potential variation thereof is transferred to the pixel electrode corresponding to the gate line of a non-selection state, through the parasitic capacitance. Therefore, the potential of the pixel electrode (referred to as "pixel potential," hereinafter) varies. In the display apparatus which is described in PTL 1, it is not mentioned whether the voltage of the source line is set to be what voltage level in the suspension period. Consequently, according to the setting of the voltage level of the source line in the suspension period, the voltage of the source line largely varies at the time of switching to the suspension period from the writing period, and the pixel potential largely varies. Hereby, a difference between display luminance in the suspension period and the display luminance in the writing period of the next frame period, becomes large. Therefore, a large flicker is generated at the time of switching to the writing period from the suspension period (at the time of switching in the frame period), and as a result, display quality is lowered.

Accordingly, an object of the present invention is to provide a liquid crystal display device that suppresses a lowering of display quality at the time of performing a low frequency drive more than the related art, a data line drive circuit that is used in the liquid crystal display device, and a drive method for the liquid crystal display device.

Solution to Problem

A first aspect of the present invention provides a liquid crystal display device which enables to drive a liquid crystal display section in a first drive mode in which a writing period where a plurality of scan lines are sequentially selected, and a suspension period having a length of the writing period or more where all of the plurality of scan lines are in a non-selection state, alternately appear in a cycle of a first drive frame period which includes the writing period and the suspension period, the apparatus including the liquid crystal display section including a plurality of data lines, the plurality of scan lines, a plurality of pixel electrodes that are positioned in a matrix shape to correspond to the plurality of data lines and the plurality of scan lines, and a common electrode that is arranged to correspond to the plurality of pixel electrodes, a data line drive circuit that gives a data signal to the plurality of pixel electrodes through the plurality of data lines, and reverses polarity of the data signal for the each writing period, and a scan line drive circuit that drives the plurality of scan lines, in which in the writing period, the data line drive circuit sets any one of a plurality of positive polarity gradation voltages, or any one of a plurality of negative polarity gradation voltages, to a voltage of the data signal, and in the suspension period, the data line drive circuit sets a voltage of a value within a range where a maximum voltage among the plurality of positive polarity gradation voltages is an upper limit, and a minimum voltage among the plurality of negative polarity gradation voltages is a lower limit, to the voltage of the data signal.

A second aspect of the present invention provides the liquid crystal display device according to the first aspect, in which in the suspension period, the data line drive circuit sets the voltage of the data signal, to an average value of the gradation voltage corresponding to a maximum gradation among the plurality of positive polarity gradation voltages, the gradation voltage corresponding to a maximum gradation among the plurality of negative polarity gradation voltages, the gradation voltage corresponding to a minimum gradation among the plurality of positive polarity gradation voltages, and the gradation voltage corresponding to a minimum gradation among the plurality of negative polarity gradation voltages.

A third aspect of the present invention provides the liquid crystal display device according to the first aspect, in which in the suspension period, the data line drive circuit sets the voltage of the data signal, to the value between the gradation voltage corresponding to the maximum gradation among the plurality of positive polarity gradation voltages, and the gradation voltage corresponding to the maximum gradation among the plurality of negative polarity gradation voltages.

A fourth aspect of the present invention provides the liquid crystal display device according to the third aspect, in which in the suspension period, the data line drive circuit sets the voltage of the data signal, to the average value of the gradation voltage corresponding to the maximum gradation among the plurality of positive polarity gradation voltages, and the gradation voltage corresponding to the maximum gradation among the plurality of negative polarity gradation voltages.

A fifth aspect of the present invention provides the liquid crystal display device according to the first aspect, in which in the suspension period, the data line drive circuit sets the voltage of the data signal, to the value between the gradation voltage corresponding to the minimum gradation among the plurality of positive polarity gradation voltages, and the gradation voltage corresponding to the minimum gradation among the plurality of negative polarity gradation voltages.

A sixth aspect of the present invention provides the liquid crystal display device according to the fifth aspect, in which in the suspension period, the data line drive circuit sets the voltage of the data signal, to the average value of the gradation voltage corresponding to the minimum gradation among the plurality of positive polarity gradation voltages, and the gradation voltage corresponding to the minimum gradation among the plurality of negative polarity gradation voltages.

A seventh aspect of the present invention provides the liquid crystal display device according to any one of the first aspect to the sixth aspect, further including a display control circuit that controls the data line drive circuit and the scan line drive circuit, and switches between the first drive mode and a second drive mode having a cycle of a second drive frame period which includes the writing period.

An eighth aspect of the present invention provides the liquid crystal display device according to the seventh aspect, further including a common potential supply circuit that gives a common potential to the common electrode, in which the common potential supply circuit sets the common potential to a value that is the same as the values in the first drive mode and the second drive mode.

A ninth aspect of the present invention provides the liquid crystal display device according to any one of the first aspect to the sixth aspect, in which the data line drive circuit includes a first terminal to receive a voltage signal for suspension period corresponding to the voltage of the data signal in the suspension period, and a second terminal to receive a switching signal indicating the switching between the writing period and the suspension period.

A tenth aspect of the present invention provides the liquid crystal display device according to the ninth aspect, in which the display control circuit gives the voltage signal for suspension period and the switching signal to the first terminal and the second terminal, respectively.

An eleventh aspect of the present invention provides the liquid crystal display device according to any one of the first aspect to the tenth aspect, in which the liquid crystal display section further includes a thin film transistor that includes a channel layer formed by an oxide semiconductor and that is connected to the pixel electrode and the data line corresponding to the pixel electrode.

A twelfth aspect of the present invention provides a data line drive circuit which includes a liquid crystal display section including a plurality of data lines, the plurality of scan lines, a plurality of pixel electrodes that are positioned in a matrix shape to correspond to the plurality of data lines and the plurality of scan lines, and a common electrode that is arranged to correspond to the plurality of pixel electrodes, is used in a liquid crystal display device that enables to drive the liquid crystal display section in a first drive mode in which a writing period where the plurality of scan lines are sequentially selected, and a suspension period having a length of the scan period or more where all of the plurality of scan lines are in a non-selection state, alternately appear in a cycle of a first drive frame period which includes the scan period and the suspension period, gives a data signal to the plurality of pixel electrodes through the plurality of data lines, and reverses polarity of the data signal for the each writing period, the circuit including a first terminal to receive a voltage signal for suspension period corresponding to a voltage of the data signal in the suspension period, a second terminal to receive a switching signal indicating the switching between the writing period and the suspension period, and a voltage switching circuit that sets any one of a plurality of positive polarity gradation voltages, or any one of a plurality of negative polarity gradation voltages to the voltage of the data signal, in the writing period, and sets the voltage which is shown in the voltage signal for suspension period to the voltage of the data signal, in the suspension period, based on the switching signal, in which the voltage which is shown in the voltage signal for suspension period, is a value within a range where a maximum voltage among the plurality of positive polarity gradation voltages is an upper limit, and a minimum voltage among the plurality of negative polarity gradation voltages is a lower limit.

A thirteenth aspect of the present invention provides a drive method for a liquid crystal display device which includes a liquid crystal display section including a plurality of data lines, a plurality of scan lines, a plurality of pixel electrodes that are positioned in a matrix shape to correspond to the plurality of data lines and the plurality of scan lines, and a common electrode that is arranged to correspond to the plurality of pixel electrodes, and enables to drive the liquid crystal display section in a first drive mode in which a writing period where the plurality of scan lines are sequentially selected, and a suspension period having a length of the scan period or more where all of the plurality of scan lines are in a non-selection state, alternately appear in a cycle of a first drive frame period which includes the scan period and the suspension period, the drive method including a data line drive step of giving a data signal to the plurality of pixel electrodes through the plurality of data lines, and reversing polarity of the data signal for the each writing period, in which in the writing period, the data line drive step includes a step of setting any one of a plurality of positive polarity gradation voltages, or any one of a plurality of negative polarity gradation voltages, to a voltage of the data signal, and in the suspension period, the data line drive step includes a step of setting the voltage of a value within a range where a maximum voltage among the plurality of positive polarity gradation voltages is an upper limit, and a minimum voltage among the plurality of negative polarity gradation voltages is a lower limit, to the voltage of the data signal.

Advantageous Effects of Invention

According to the first aspect of the present invention, in the suspension period of the first drive mode (corresponding to a low frequency drive mode), the voltage of the value within the range where the maximum voltage among the plurality of positive polarity gradation voltages is the upper limit, and the minimum voltage among the plurality of negative polarity gradation voltages is the lower limit, is applied to each data line. Therefore, by presence of parasitic capacitance that is formed between the data line corresponding to each pixel electrode and the pixel electrode, and the parasitic capacitance that is formed between the data line which interposes the pixel electrode therebetween and is adjacent to the data line corresponding to each pixel electrode, and the pixel electrode, a variation in pixel potential that is generated at the time of switching to the suspension period from the writing period, is as follows. Furthermore, in description of the following effects of the invention, it is assumed that a liquid crystal display device of the related art performing the low frequency drive, sets a data voltage in the suspension period to be the voltage out of the gradation voltage range. According to the first aspect of the present invention, the voltage of the data signal in the suspension period becomes the value within the range described above, and thereby, a potential variation in the data line at the time of switching to the suspension period from the writing period becomes smaller than the related art. Therefore, the variation in the pixel potential which is generated at the time of switching to the suspension period from the writing period, becomes smaller than the related art. Hereby, a difference between display luminance in the suspension period and the display luminance in the writing period of the next frame period, becomes smaller than the related art. Consequently, a flicker which is generated at the time of switching to the writing period from the suspension period (at the time of switching in the frame period), is suppressed more than the related art. As a result, it is possible to suppress a lowering of display quality more than the related art.

According to the second aspect of the present invention, in the suspension period, the voltage of the data signal is set to the average value of the gradation voltage (maximum gradation positive polarity voltage) corresponding to the maximum gradation among the plurality of positive polarity gradation voltages, the gradation voltage (maximum gradation negative polarity voltage) corresponding to the maximum gradation among the plurality of negative polarity gradation voltages, the gradation voltage (minimum gradation positive polarity voltage) corresponding to the minimum gradation among the plurality of positive polarity gradation voltages, and the gradation voltage (minimum gradation negative polarity voltage) corresponding to the minimum gradation among the plurality of negative polarity gradation voltages. Therefore, at the positive polarity and the negative polarity, the variation in the pixel potential at the time of switching to the writing period from the suspension period, is approximately uniformized. Hereby, it is possible to further enhance the suppression effect of the lowering in the display quality.

According to the third aspect of the present invention, in the suspension period, the voltage of the data signal is set to the value between the maximum gradation positive polarity voltage and the maximum gradation negative polarity voltage, and thereby, it is possible to have the same effects as the first aspect of the present invention. In particular, when the value which is close to the average value between the maximum gradation positive polarity voltage and the maximum gradation negative polarity voltage, is adopted as a voltage of the data signal in the suspension period, at the positive polarity and the negative polarity, the variation in the pixel potential at the time of switching to the writing period from the suspension period, is approximately uniformized. Hereby, it is possible to further enhance the suppression effect of the lowering in the display quality.

According to the fourth aspect of the present invention, in the suspension period, the voltage of the data signal is set to the average value of the maximum gradation positive polarity voltage and the maximum gradation negative polarity voltage. Therefore, at the positive polarity and the negative polarity, the variation in the pixel potential at the time of switching to the writing period from the suspension period, is approximately uniformized. Hereby, it is possible to further enhance the suppression effect of the lowering in the display quality.

According to the fifth aspect of the present invention, in the suspension period, the voltage of the data signal is set to the value between the minimum gradation positive polarity voltage and the maximum gradation negative polarity voltage, and thereby, it is possible to have the same effects as the first aspect of the present invention. In particular, when the value which is close to the average value between the minimum gradation positive polarity voltage and the maximum gradation negative polarity voltage, is adopted as a voltage of the data signal in the suspension period, at the positive polarity and the negative polarity, the variation in the pixel potential at the time of switching to the writing period from the suspension period, is approximately uniformized. Hereby, it is possible to further enhance the suppression effect of the lowering in the display quality.

According to the sixth aspect of the present invention, in the suspension period, the voltage of the data signal is set to the average value of the minimum gradation positive polarity voltage and the maximum gradation negative polarity voltage. Therefore, at the positive polarity and the negative polarity, the variation in the pixel potential at the time of switching to the writing period from the suspension period, is approximately uniformized. Hereby, it is possible to further enhance the suppression effect of the lowering in the display quality.

According to the seven aspect of the present invention, since it is possible to switch between the first drive mode and the second drive mode, it is possible to perform the display depending on intended use.

According to the eighth aspect of the present invention, in the liquid crystal display device which enables to switch between the first drive mode and the second drive mode, since the common potential becomes the same value in the first drive mode and the second drive mode, it is not necessary to switch the common potential depending on the switching of the drive mode. Hence, it is possible to suppress the lowering of the display quality in a simple configuration.

According to the ninth aspect of the present invention, using the data line drive circuit including the first terminal and the second terminal, it is possible to realize the liquid crystal display device which enables to suppress the lowering of the display quality at the time of performing the low frequency drive.

According to the tenth aspect of the present invention, the display control circuit gives the suspension period voltage signal and the switching signal to the data line drive circuit, and thereby, it is possible to have the same effects as the first aspect of the present invention.

According to the eleventh aspect of the present invention, the thin film transistor where the channel layer is formed by the oxide semiconductor, is used. Therefore, it is possible to sufficiently retain the pixel potential. Hereby, even when the suspension period having the length of the writing period or more is arranged, it is unlikely to generate the lowering of the display quality.

According to the twelfth aspect of the present invention, by using the data line drive circuit relating to the twelfth aspect, in the liquid crystal display device which enables to drive the liquid crystal display section in the first drive mode, it is possible to have the same effects as the first aspect of the present invention.

According to the thirteenth aspect of the present invention, in the drive method for the liquid crystal display device, it is possible to have the same effects as the first aspect of the present invention.

DESCRIPTION OF EMBODIMENTS

Hereinafter, with reference to the accompanying drawings, a first embodiment to a third embodiment of the present invention will be described. In the following, the reference signs relating to voltage, potential, and capacitance, may represent dimensions of the voltage, the potential, and the capacitance. Moreover, in the following, each of m and n represents integers of 2 or more.

1. First Embodiment

1. 1 Overall Configuration and Operation Outline

Figure 1:
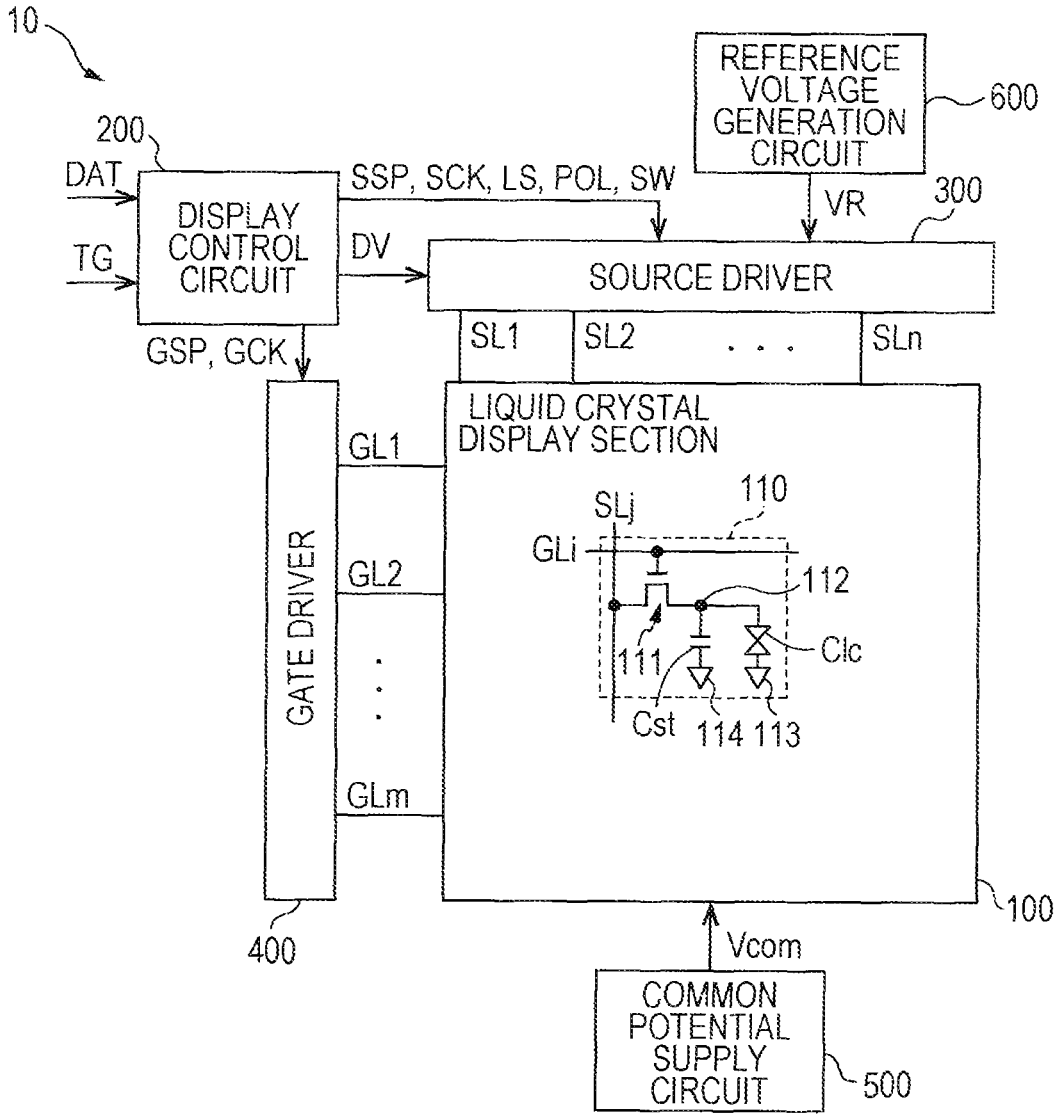
FIG. 1 is a block diagram illustrating an overall configuration of a liquid crystal display device according to a first embodiment of the present invention.

FIG. 1 is a block diagram illustrating a configuration of an active matrix type liquid crystal display device 10 according to the first embodiment of the present invention. As shown in FIG. 1, the liquid crystal display device 10 includes a liquid crystal display section 100, a display control circuit 200, a source driver (data line drive circuit) 300, a gate driver (scan line drive circuit) 400, a common potential supply circuit 500, and a reference voltage generation circuit 600. To each of the source driver 300, the gate driver 400, the common potential supply circuit 500, and the reference voltage generation circuit 600, the power is supplied from a power circuit which is not shown in the drawing. The liquid crystal display device 10 according to the present embodiment, is a liquid crystal display device which is operatable in a low frequency drive. In the following, a mode at which the low frequency drive (drive in which 1 frame period includes a writing period and a suspension period) is performed, is referred to as "low frequency drive mode," and a mode at which a normal drive (drive in which 1 frame period includes the writing period) is performed, is referred to as "normal drive mode." The low frequency drive mode and the normal drive mode correspond to a first drive mode and a second drive mode, respectively. Moreover, each frame period in the low frequency drive mode and each frame period in the normal drive mode correspond to a first drive frame period and a second drive frame period, respectively. For example, the liquid crystal display device 10 according to the present embodiment, enables to switch between the low frequency drive mode and the normal drive mode, but may be favorable if being operatable at least in the low frequency drive mode. Additionally, in the liquid crystal display device according to the present embodiment and each embodiment described later, a polarity reversal drive is performed in order to prevent deterioration of the liquid crystal.

In the liquid crystal display section 100, n source lines (data lines) SL1 to SLn, m gate lines (scan lines) GL1 to GLm, and a plurality of (m×n) pixel formation sections 110 which are arranged to correspond to an intersection point of the n source lines SL1 to SLn and the m gate lines GL1 to GLm, are arranged. One pixel (one sub-pixel in case of a color display) is formed by one pixel formation section 110. In FIG. 1, the pixel formation section 110 of an i-th row and a j-th column which is arranged to correspond to an intersection point of a source line SLj and a gate line GLi, is shown (i=1 to m, j=1 to n). One pixel formation section 110, is configured by a TFT (Thin Film Transistor) 111 where a gate terminal is connected to the gate line GLi which passes through the corresponding intersection point, and a source terminal is connected to the source line SLj which passes through the intersection point, a pixel electrode 112 that is connected to a drain terminal of the TFT 111, a common electrode (referred to as a counter electrode) 113 that is commonly arranged to correspond to the m×n pixel formation section 110, a subsidiary electrode 114, and a liquid crystal layer that is interposed between the pixel electrode 112 and the common electrode 113. For example, the subsidiary electrode 114 is arranged along each gate line. Therefore, a liquid crystal capacitance Clc is formed by the pixel electrode 112 and the common electrode 113, and a subsidiary capacitance Cst is formed by the pixel electrode 112 and the subsidiary electrode 114. In the present embodiment, it is assumed that the same potential to each other is given to the common electrode 113 and the subsidiary electrode 114. However, for example, the subsidiary electrode 114 may be driven per a row. Moreover, it is assumed that the liquid crystal display section 100 in the present embodiment is in a normally black mode. In addition, the liquid crystal display section 100 in the present embodiment, may be in any one of a longitudinal electric field mode and a lateral electric field mode.

In the present embodiment, an oxide TFT is used as a TFT 111. In more detail, a channel layer of the TFT 111 is formed by IGZO (InGaZnOx) which uses indium (In), gallium (Ga), zinc (Zn), and oxygen (O) as a main ingredient. Hereinafter, the TFT using IGZO in the channel layer is referred to as "IGZO-TFT." Since a silicon based TFT (to which a TFT using amorphous silicon or the like in the channel layer is called) has relatively large off-leak current, when the silicon based TFT is used as a TFT 111, an electric charge which is retained in pixel capacitance, is leaked out through the TFT 111, and as a result, the voltage to be retained at the time of being in an off state, varies. However, the IGZO-TFT has very small off-leak current in comparison with the silicon based TFT. Hence, it is possible to retain the voltage which is written in the pixel capacitance in the more longer period. Furthermore, in addition to IGZO, as an oxide semiconductor, for example, even when the oxide semiconductor including at least one among indium, gallium, zinc, copper (Cu), silicon (Si), tin (Sn), aluminum (Al), calcium (Ca), germanium (Ge), and lead (Pb), is used in the channel layer, the same effects are obtained.

The display control circuit 200 receives an image signal DAT that is sent from the outside, and a timing signal group TG of a horizontal synchronization signal, a vertical synchronization signal, and the like, and in the writing period, outputs a digital video signal DV, a source start pulse SSP for controlling an image display in the liquid crystal display section 100, a source clock SCK, a latch strobe signal LS, a polarity signal FOL, a switching signal SW, a gate start pulse GSP, and a gate clock GCK. The switching signal SW shows the switching between the writing period and the suspension period in the low frequency drive mode. Moreover, in the suspension period, for example, the display control circuit 200 stops the output of the digital video signal DV, the source start pulse SSP, the source clock SCK, the latch strobe signal LS, the polarity signal POL, the gate start pulse CSP, and the gate clock GCK, or sets the signals to a fixed potential.

The source driver 300 receives the digital video signal DV, the source start pulse SSP, the source clock SCK, the latch strobe signal LS, the polarity signal POL, and the switching signal SW which are output from the display control circuit 200, and supplies a data signal to each source line. Based on the switching signal SW, the source driver 300 enables to operate depending on the writing period or the suspension period. In the writing period, at the timing of generating the pulse of the source clock SCK, the source driver 300 sequentially retains the digital image signal DV that shows a gradation value corresponding to a data voltage to be applied to each source line. Therefore, at the timing of generating the pulse of the latch strobe signal LS, the source driver 300 converts the retained digital video signal DV into a gradation voltage which is an analog voltage, depending on the polarity signal POL, and supplies the data signal corresponding to the gradation voltage (data voltage) after the conversion, to all source lines. By reversing the voltage polarity of each source line depending on the polarity signal POL, the polarity reversal drive is performed. On the other hand, in the suspension period, the source driver 300 applies a voltage V_m for suspension period to all source lines. In this manner, when the polarity of the data signal is the positive polarity or the negative polarity, the source driver 300 is configured so as to set any one of a plurality of positive polarity gradation voltages, or any one of a plurality of negative polarity gradation voltages, to a data voltage, in the writing period, and the source driver 300 is configured so as to set the voltage V_m for suspension period to a data voltage, in the suspension period. In the present embodiment, the voltage V_m for suspension period may be generated within the source driver 300, or may be given from the outside (for example, the display control circuit 200) of the source driver 300. The voltage V_m for suspension period will be described later, in detail. In the low frequency drive mode, the source driver 300 repeats the operation in the writing period and the operation in the suspension period described above, as a cycle of 1 frame period.

In the source driver 300, when the data signal displaying a predetermined gradation into the liquid crystal display section 100 is generated, the reference voltage generation circuit 600 generates a plurality of reference voltage signals VR which become the reference thereof, and gives the plurality of generated reference voltage signals VR, to the source driver 300.

In the writing period, based on the gate start pulse GSP and the gate clock GCK which are output from the display control circuit 200, by performing the application to each of the gate lines GL1 to GLm of an active scan signal, the gate driver 400 performs scans of the gate lines GL1 to GLm. Moreover, in the suspension period, the gate driver 400 do not perform the scans of the gate lines GL1 to GLm. In the low frequency drive mode, the gate driver 400 repeats the operation in the writing period and the operation in the suspension period described above, as a cycle of 1 frame period.

The common potential supply circuit 500 gives a predetermined common potential Vcom, to each of the common electrode 113 and the subsidiary electrode 114. In the pixel capacitance, the voltage corresponding to a potential difference between the pixel potential and the common potential Vcom, is retained. Furthermore, when each of the subsidiary electrodes 114 is individually driven as described above, the common potential supply circuit 500 gives the common potential Vcom only to the common electrode 113, and for example, the predetermined potential from a subsidiary electrode drive circuit, is given to each subsidiary electrode 114.

In this manner, based on the image signal DAT which is transmitted from the outside of the liquid crystal display device 10, the pixel is displayed in the liquid crystal display section 100.

1. 2 Examination of Related Art Example

Before describing the operation of the liquid crystal display device 10 according to the present embodiment, a liquid crystal display device (hereinafter, there is a case of being referred to as "related art example.") of the related art which performs the low frequency drive, will be examined. Furthermore, except for the operation of the source driver 300 in the suspension period, a basic configuration and operations of the related art example are the same as those in the present embodiment.

Figure 2:
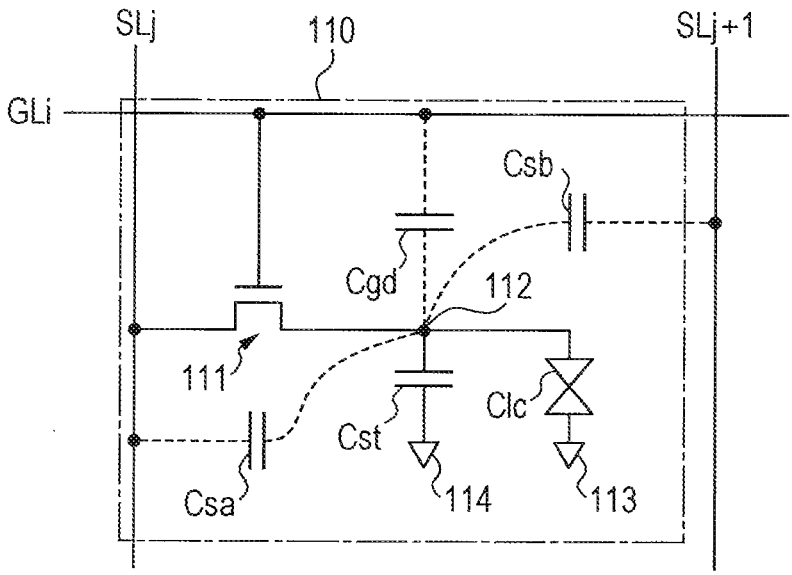
FIG. 2 is a circuit diagram for describing parasitic capacitances which are formed in a pixel formation section in the liquid crystal display device shown in FIG. 1.

FIG. 2 is a circuit diagram for describing parasitic capacitance which is formed in the pixel formation section 110 in the liquid crystal display device 10 shown in FIG. 1. As shown in FIG. 2, in the pixel formation section 110 of the i-th row and the j-th column, a parasitic capacitance Cgd (referred to as "first parasitic capacitance," hereinafter) is formed between the pixel electrode 112 and the gate line GLi of the i-th row, a parasitic capacitance Csa (referred to as "second parasitic capacitance," hereinafter) is formed between the pixel electrode 112 and the source line SLj of the j-th column, and a parasitic capacitance Csb (referred to as "third parasitic capacitance," hereinafter) is formed between the pixel electrode 112 and the source line SLj+1 of the j+1-th column.

Figure 3:
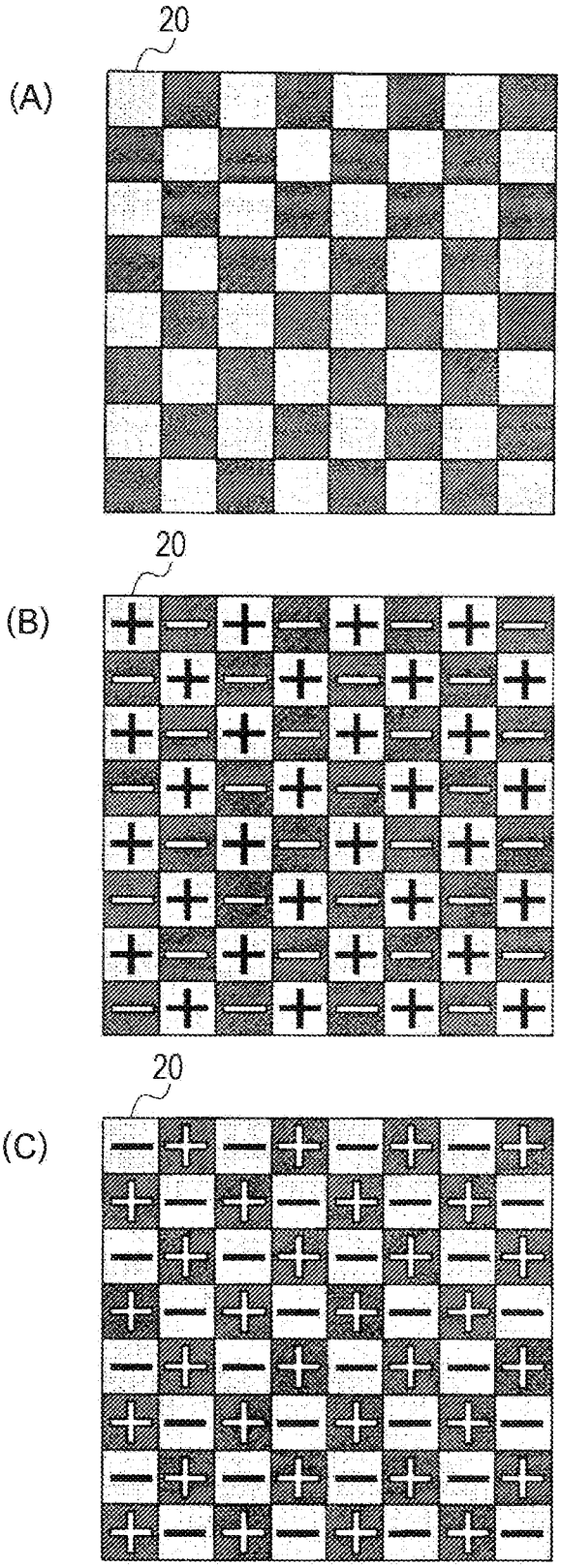
FIG. 3 is a diagram for describing a flicker pattern. (A) is a diagram illustrating the flicker pattern. (B) is a diagram illustrating polarity in an N-th frame. (C) is a diagram illustrating the polarity in an N+1-th frame.

Here, in a state of forming the parasitic capacitance as shown in FIG. 2, the case where a flicker pattern is displayed, is considered. As a flicker pattern, as shown in FIG. 3(A), in the case of a monochrome display, a pattern in which the display of white gradation or intermediate gradation (simply referred to as "white gradation," hereinafter), and the display of black gradation are alternately performed per a pixel 20, is called. Furthermore, when the sub-pixels of R (red), G (green), and B (blue) are present as the color display, the display of the white gradation and the display of the black gradation are alternately performed per a sub-pixel, but here, the case of the monochrome display is assumed, for convenience of the description.

FIG. 3(B) and FIG. 3(C) are diagrams illustrating polarity of each pixel in an N-th frame period (N is a natural number), and the polarity of each pixel 20 in an N+1-th frame period in the case where the flicker pattern is displayed by performing a dot reversal drive, respectively. As shown in FIG. 3(B) and FIG. 3(C), the polarity is reversed per one pixel 20 in each of a horizontal direction and a vertical direction, and the polarity of each pixel 20 is reversed per 1 frame period. In the flicker pattern shown in FIG. 3(A) to FIG. 3(C), the pixels 20 of the white gradation, all become at the same polarity in each frame, and the polarity is reversed per 1 frame period. The flicker pattern described above, is suitable for intended use to check a luminance difference between the polarities.

Figure 4:
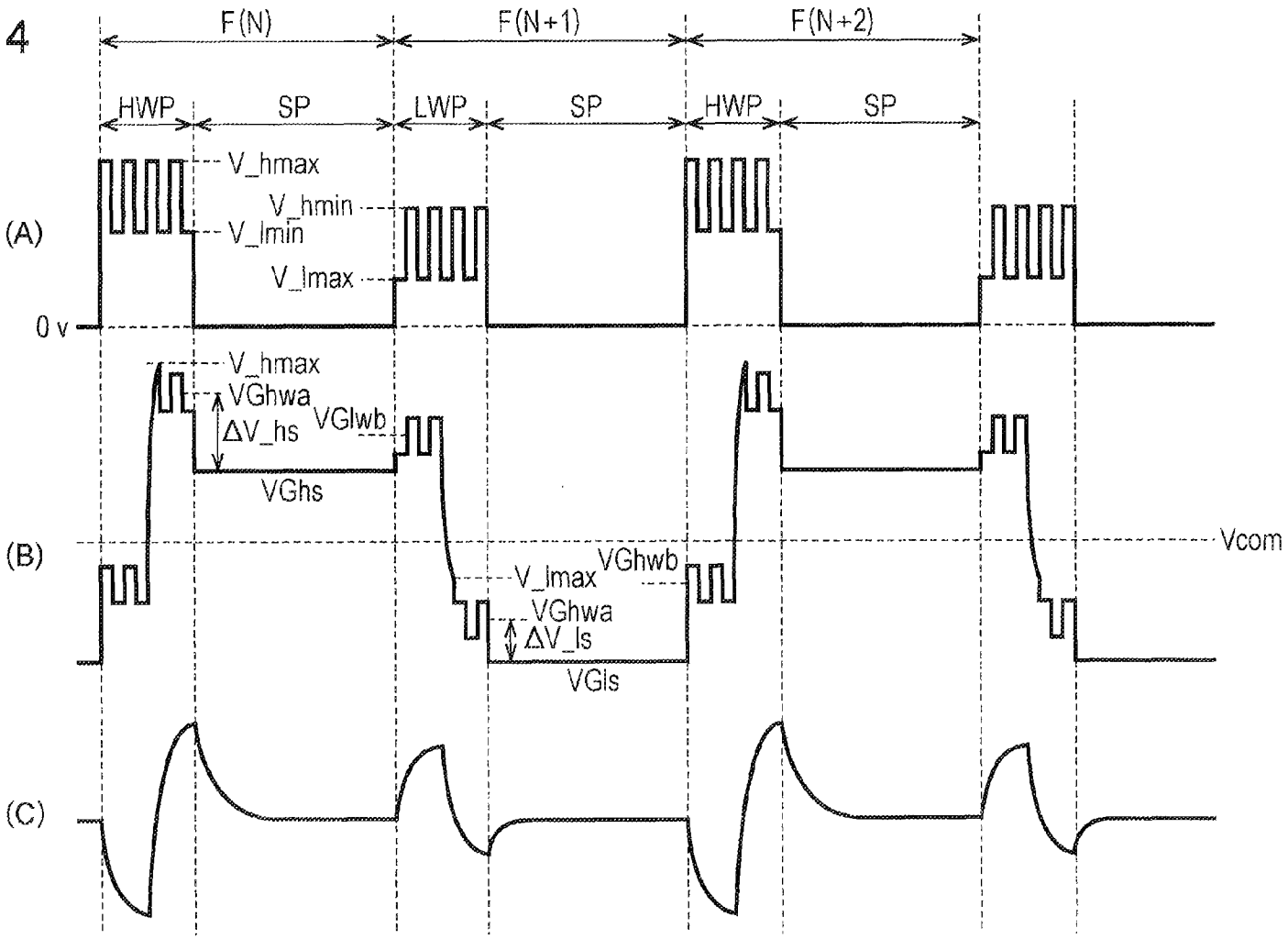
FIG. 4 is a diagram for describing display luminance which is obtained by a liquid crystal display device according to a related art example. (A) is a waveform diagram illustrating a voltage of a source line SLj. (B) is a waveform diagram illustrating pixel potential in a pixel formation section 110 of an i-th row and a j-th column corresponding to the source line SLj. (C) is a waveform diagram illustrating the display luminance in the pixel formation section 110 of the i-th row and the j-th column.

FIG. 4 is a diagram for describing display luminance which is obtained by the liquid crystal display device according to the related art example. In more detail, FIG. 4(A) is a waveform diagram illustrating the voltage (data voltage) of the source line SLj, FIG. 4(B) is a waveform diagram illustrating the pixel potential in the pixel formation section 110 of the i-th row and the j-th column corresponding to the source line SLj, and FIG. 4(C) is a waveform diagram illustrating the display luminance in the pixel formation section 110 of the i-th row and the j-th column. In FIG. 4(A) to FIG. 4(C), the flicker patterns which are shown in FIG. 3(A) to FIG. 3(C), are displayed. The display luminance shown in FIG. 4(C), varies depending on the potential difference between the pixel potential shown in FIG. 4(B) and the common potential Vcom. Furthermore, a value of the common potential Vcom shown in FIG. 4(B), is a simple illustration, and is not limited to the value. Moreover, note that waveform dullness, a length of each period, and the like are schematically shown in FIG. 4(A) to FIG. 4(C) (in the same manner as FIG. 6(A) to FIG. 6(C), FIG. 8(A), FIG. 8(B), FIG. 9(A), and FIG. 9(B) described later).

In FIG. 4(A) to FIG. 4(C), the N-th to an N+2-th periods are represented by "F(N) to F(N+2)," respectively. The period (referred to as "positive polarity writing period," hereinafter) in which the positive polarity data voltage is written into the pixel formation section 110 of the i-th row and the j-th column, is represented by "HWP," the period (referred to as "negative polarity writing period," hereinafter) in which the negative polarity data voltage is written into the pixel formation section 110 of the i-th row and the j-th column, is represented by "LWP," and the suspension period is represented by "SP." In other words, the positive polarity writing period HWP is a writing period for performing the positive polarity white gradation display and the negative polarity black gradation display in the flicker pattern. In other words, the negative polarity writing period LWP is a writing period for performing the negative polarity white gradation display and the positive polarity black gradation display in the flicker pattern. Each frame period includes the writing period and the suspension period. Moreover, The length of each frame period is 200 ms, the length of each writing period is 16.7 ms, and the length of the suspension period SP is 183.3 ms. That is, a refresh rate is 5 Hz. Furthermore, if the suspension period SP has the length of each writing period or more, it is favorable, and the length of each period and the refresh rate are not limited to examples shown here.

In FIG. 4(A), the gradation voltage (referred to as "maximum gradation positive polarity voltage," hereinafter) corresponding to a maximum gradation among the plurality of positive polarity gradation voltages, is represented by "V_hmax," and the gradation voltage (referred to as "maximum gradation negative polarity voltage," hereinafter) corresponding to a maximum gradation among the plurality of negative polarity gradation voltages, is represented by "V_lmax." The gradation voltage (referred to as "minimum gradation positive polarity voltage," hereinafter) corresponding to a minimum gradation among the plurality of positive polarity gradation voltages, is represented by "V_hmin," and the gradation voltage (referred to as "minimum gradation negative polarity voltage," hereinafter) corresponding to a minimum gradation among the plurality of negative polarity gradation voltages, is represented by "V_lmin." In the present embodiment adopting the normally black mode, the maximum gradation positive polarity voltage V_hmax is a maximum voltage among the plurality of positive polarity gradation voltages, and the maximum gradation negative polarity voltage V_lmax is a minimum voltage among the plurality of negative polarity gradation voltages. The minimum gradation positive polarity voltage V_hmin is a minimum voltage among the plurality of positive polarity gradation voltages, and the minimum gradation negative polarity voltage V_lmin is a maximum voltage among the plurality of negative polarity gradation voltages. A magnitude relationship of the maximum gradation positive polarity voltage V_hmax, the maximum gradation negative polarity voltage V_lmax, the minimum gradation positive polarity voltage V_hmin, and the minimum gradation negative polarity voltage V_lmin, is given by the following equation (1).

$$V_h\max > V_h\min > V_l\min > V_l\max \quad (1)$$

First, the operation in the N-th frame period F(N), will be described. As described above, since the polarity and the black and white gradation are reversed per one pixel 20 in the vertical direction, in the positive polarity writing period HWP, the voltage of the source line SLj of the j-th column, is repeated between the maximum gradation positive polarity voltage V_hmax and the minimum gradation negative polarity voltage V_lmin, per 1 horizontal period. Moreover, since the polarity and the black and white gradation are reversed per one pixel 20 in the horizontal direction, the voltage of the source line SLj+1 of the j+1-th column, is repeated between the maximum gradation positive polarity voltage V_hmax and the minimum gradation negative polarity voltage V_lmin, per 1 horizontal period, in a reverse order to the voltage of the source line SLj of the j-th column. In the positive polarity writing period HWP, based on the gate start pulse GSP and the gate clock GCK, the gate lines GL1 to GLm are scanned (sequentially selected). Furthermore, the operation before the writing of the data voltage is actually performed into the pixel formation section 110 of the i-th row and the j-th column in the positive polarity writing period HWP, will be described later in the operation description of the N-th frame period F(N+2).

If the gate line GLi of the i-th row is selected, the TFT 111 within the pixel formation section 110 of the i-th row and the j-th column is turned on, and the maximum gradation positive polarity voltage V max is applied to the pixel electrode 112, through the source line SLj of the j-th column. When the selection of the gate line GLi of the i-th row is completed, and the TFT 111 is turned off, a potential variation in the gate line GLi is transferred to the pixel electrode 112, through the first parasitic capacitance Cgd. A field through voltage ΔVgd which is generated in the pixel electrode 112 in this manner, is given by the following equation (2).

$$\Delta Vgd = (Cgd/\Sigma C)(Vgh - Vgl) \quad (2)$$

Here, ΣC represents the total sum of all capacitances contributing to the pixel electrode 112, Vgh represents a high level (level at the time of the selection) of the gate line GLi, and Vgl represents a low level (level at the time of the non-selection) of the gate line GLi.

Moreover, when the flicker pattern is displayed, the source line SLj of the j-th and the source line SLj+1 of the 1-th, change at the reverse polarity to each other, per 1 horizontal period. At the time of the non-selection of the gate line GLi of the i-th row, the potential variation in the source line SLj of the j-th column and the source line SLj+1 of the j+1-th column, is transferred to the pixel electrode 112, through the second parasitic capacitance Csa and the third parasitic capacitance Csb, respectively. A pixel potential variation ΔVg_s (referred to as "pixel potential variation relating to the source line after the writing in the writing period," hereinafter) which is generated in this manner, is given by the following equation (3).

$$\Delta Vg_s = (Csa/\Sigma C)\Delta Vsa + (Csb/\Delta C)\Delta Vsb \quad (3)$$

Here, ΔVsa represents the potential variation in the source line SLj of the j-th column, ΔVsb represents the potential variation in the source line SLj+1 of the j+1-th column. Furthermore, when the flicker pattern is displayed, ΔVsa and ΔVsb become at positive and negative in reverse to each other.

In this way, an average pixel potential VGhwa (referred to as "average pixel potential after the positive polarity writing," hereinafter) after the writing is completed in positive polarity writing period HWP, is given by the following equation (4).

$$VGhwa = Vs - \Delta Vgd + \Delta Vg_s \quad (4)$$

Here, Vs represents the data voltage which is written into the pixel formation section 110 of the i-th row and the j-th column, and in the example of the flicker pattern described above, Vs=V_hmax. Moreover, ΔVg_s is actually the average value in the equation (4).

In the suspension period SP of the N-th frame period F(N), the scans of the gate lines GL1 to GLm stop. In the related art example, as shown in FIG. 4(A), the voltage of the source line SLj is assumed to be set into, for example, 0V. As described above, by setting the suspension period SP to have the length of the writing period or more, it is possible to sufficiently lower the refresh rate. Therefore, power consumption is reduced.

Incidentally, as shown in FIG. 4(A), at the time of switching to the suspension period SP from the positive polarity writing period HWP, each of the voltages of the source line SLj of the j-th column and the source line SLj+1 of the j+1-th column, is changed to 0V. Hence, the potential variation in the source line SLj of the j-th column and the source line SLj+1 of the j+1-th column, is transferred to the pixel electrode 112, through the second parasitic capacitance Csa and the third parasitic capacitance Csb, respectively. A pixel potential variation ΔV_hs at the time of switching to the suspension period SP from the positive polarity writing period HWP which is generated in this manner, is approximately given by the following equation (5).

$$\Delta V_hs = [(Csa/\Sigma C)(V_h\max + V_l\min)/2 + (Csb/\Sigma C)(V_h\max + V_l\min)/2]/2 \quad (5)$$

Here, "(V_hmax+V_lmin)/2" approximately represents the voltage of the source line SLj of the j-th column and the voltage of the source line SLj+1 of the j+1-th column at the time of completing the positive polarity writing period HWP. Note that the value is changed by the image to be actually displayed.

A pixel potential VGhs of the suspension period SP (hereinafter, there is a case of being referred to as "positive polarity suspension period.") after the positive polarity writing period HWP, is given by the following equation (6).

$$VGhs = VGhwa - \Delta V_hs \quad (6)$$

As shown in FIG. 4(C), by the potential variation ΔV_hs at the time of switching to the suspension period SP from the positive polarity writing period HWP, the potential difference (voltage which is retained in the pixel capacitance) between the pixel potential and the common potential Vcom, becomes small. Therefore, in the suspension period SP after the positive polarity writing period HWP, the display luminance decreases in comparison with that at the time of completing the positive polarity writing period HWP. Furthermore, when the oxide TFT is used as a TFT 111, since the off-leak current is exceedingly small, in the description of the present embodiment, it is assumed that the value of the pixel potential VGhs is not changed in the positive polarity suspension period.

As shown in FIG. 4(A), at the time of switching to the negative polarity writing period LWP from the suspension period SP (at the time of switching to the N+1-th frame period F(N+1) from the N-th frame period F(N)), the voltage of the source line SLj of the j-th column, is changed to the maximum gradation negative polarity voltage V_lmax from 0V. Moreover, the source line SLj+1 of the j+1-th column, is changed to the minimum gradation positive polarity voltage V_hmin from 0V (not shown). Hence, the potential variation in the source line SLj of the j-th column and the source line SLj+1 of the j+1-th column, is transferred to the pixel electrode 112, through the second parasitic capacitance Csa and the third parasitic capacitance Csb, respectively. In this manner, at the time of switching to the negative polarity writing period LWP from the suspension period SP, the pixel potential variation is generated. Hereinafter, the pixel potential variation which is generated at the time of switching to the negative polarity writing period LWP from the suspension period SP, is referred to as "pixel potential variation at the time of transiting to the negative polarity writing period."

In the negative polarity writing period LWP of the N+1-th frame period F(N+1), the voltage of the source line SLj of the j-th column, is repeated between the maximum gradation negative polarity voltage V_lmax and the minimum gradation positive polarity voltage V_hmin, per 1 horizontal period. In addition, the voltage of the source line SLj+1 of the j+1-th column, is repeated between the maximum gradation negative polarity voltage V_lmax and the minimum gradation positive polarity voltage V_hmin, per 1 horizontal period, in a reverse order to the voltage of the source line SLj of the j-th column. Until the gate line GLi of the i-th row is selected, the potential variation in the source line SLj of the j-th column and the source line SLj+1 of the j+1-th column, is transferred to the pixel electrode 112, through the second parasitic capacitance Csa and the third parasitic capacitance Csb, respectively. By the pixel potential variation (referred to as "pixel potential variation before the negative polarity writing," hereinafter) before the writing of the data voltage is actually performed into the pixel formation section 110 of the i-th row and the j-th column in the negative polarity writing period LWP, and the pixel potential variation at the time of transiting to the negative polarity writing period, which are generated in this manner, an average pixel potential VGlwb (referred to as "average pixel potential before the negative polarity writing," hereinafter) before the writing of the data voltage is actually performed into the pixel formation section 110 of the i-th row and the j-th column in the negative polarity writing period LWP, is determined. As shown in FIG. 4(B), the average pixel potential VGlwb before the negative polarity writing, becomes higher than the pixel potential VGhs of the positive polarity suspension period. Therefore, the potential difference between the average pixel potential VGlwb before the negative polarity writing and the common potential Vcom, becomes larger than the potential difference between the pixel potential VGhs of the positive polarity suspension period and the common potential Vcom. Hereby, as shown in FIG. 4(C), at the time of switching to the N+1-th frame period F(N+1) from the N-th frame period F(N), a sharp change in luminance (luminance increase) is generated. As a result, a flicker is generated.

Thereafter, if the gate line GLi of the i-th row is selected, by the same operation as the positive polarity writing period HWP, the maximum gradation negative polarity voltage V_lmax is applied to the pixel electrode 112 within the pixel formation section 110 of the i-th row and the j-th column, through the source line SLj of the j-th column. In the negative polarity writing period LWP, when the selection of the gate line GLi of the i-th row is completed, and the TFT 111 is turned off, the field through voltage ΔVgd is generated, and the pixel potential variation ΔVg_s relating to the source line after the writing in the writing period, is generated, in the same manner as in the positive polarity writing period HWP. Furthermore, the average pixel potential VGhwa (referred to as "average pixel potential after the negative polarity writing," hereinafter) after the writing is completed in negative polarity writing period LWP, is given by the above equation (4), in the same manner as that in the positive polarity writing period HWP. Here, the potential difference between the average pixel potential VGhwa after the negative polarity writing and the common potential Vcom, becomes relatively larger than the potential difference between the average pixel potential VGlwb before the negative polarity writing and the common potential Vcom. Therefore, not only a luminance change at the time of switching to the N+1-th frame period F(N+1) from the N-th frame period F(N), but also the luminance change (luminance decrease) before and after the writing in the negative polarity writing period LWP, become relatively large. As a result, degrees of flicker further worsen.

As shown in FIG. 4(A), at the time of switching to the suspension period SP from the negative polarity writing period LWP, each of the voltages of the source line SLj of the j-th column and the source line SLj+1 of the j+1-th column, is changed to 0V. Hence, the potential variation in the source line SLj of the j-th column and the source line SLj+1 of the j+1-th column, is transferred to the pixel electrode 112, through the second parasitic capacitance Csa and the third parasitic capacitance Csb, respectively. A pixel potential variation ΔV_ls at the time of switching to the suspension period SP from the negative polarity writing period LWP which is generated in this manner, is approximately given by the following equation (7).

$$\Delta V_ls=[(Csa/\Sigma C)(V_l\max+V_h\min)]/2+(Csb/\Sigma C)(V_l\max+V_h\min)/2]/2 \quad (7)$$

Here, "(V_lmax+V_hmin)/2" approximately represents the voltage of the source line SLj of the j-th column and the voltage of the source line SLj+1 of the j+1-th column at the time of completing the negative polarity writing period LWP. Note the point in which the value is changed by the image to be actually displayed.

A pixel potential VGls of the suspension period SP (hereinafter, there is a case of being referred to as "negative polarity suspension period.") after the negative polarity writing period LWP, is given by the following equation (8).

$$VGls=VGlwa-\Delta V_ls \quad (8)$$

As shown in FIG. 4(C), by the potential variation ΔV_ls at the time of switching to the suspension period SP from the negative polarity writing period LWP, the potential difference between the pixel potential and the common potential Vcom, becomes large. Therefore, in the suspension period SP after the negative polarity writing period LWP, the display luminance increases in comparison with that at the time of completing the negative polarity writing period LWP. Furthermore, when the oxide TFT is used as a TFT 111, since the off-leak current is exceedingly small, in the description of the present embodiment, it is assumed that the value of the pixel potential VGls is not changed in the negative polarity suspension period.

As shown in FIG. 4(A), at the time of switching to the positive polarity writing period HWP from the suspension period SP (at the time of switching to the N+2-th frame period F(N+2) from the N+1-th frame period F(N+1)), the voltage of the source line SLj of the j-th column, is changed to the maximum gradation positive polarity voltage V_hmax from 0V. Moreover, the source line SLj+1 of the j+1-th column, is changed to the minimum gradation negative polarity voltage V_lmin from 0V (not shown). Hence, the potential variation in the source line SLj of the j-th column and the source line SLj+1 of the j+1-th column, is transferred to the pixel electrode 112, through the second parasitic capacitance Csa and the third parasitic capacitance Csb, respectively. In this manner, at the time of switching to the positive polarity writing period HWP from the suspension period SP, the pixel potential variation is generated. Hereinafter, the pixel potential variation which is generated at the time of switching to the positive polarity writing period HWP from the suspension period SP, is referred to as "pixel potential variation at the time of transiting to the positive polarity writing period."

In the positive polarity writing period HWP of the N+2-th frame period F(N+2), the voltage of the source line SLj of the j-th column, is repeated between the maximum gradation positive polarity voltage V_hmax and the minimum gradation negative polarity voltage V_lmin, per 1 horizontal period. In addition, the voltage of the source line SLj+1 of the j+1-th column, is repeated between the maximum gradation positive polarity voltage V_hmax and the minimum gradation negative polarity voltage V_lmin, per 1 horizontal period, in a reverse order to the voltage of the source line SLj of the j-th column. Until the gate line GLi of the i-th row is selected, the potential variation in the source line SLj of the j-th column and the source line SLj+1 of the j+1-th column, is transferred to the pixel electrode 112, through the second parasitic capacitance Csa and the third parasitic capacitance Csb, respectively. By the pixel potential variation (referred to as "pixel electrode variation before the positive polarity writing," hereinafter) before the writing of the data voltage is actually performed into the pixel formation section 110 of the i-th row and the j-th column in the positive polarity writing period HWP, and the pixel electrode variation at the time of transiting to the positive polarity writing period, which are generated in this manner, an average pixel potential VGhwb (referred to as "average pixel potential before the positive polarity writing," hereinafter) before the writing of the data voltage is actually performed into the pixel formation section 110 of the i-th row and the j-th column in the positive polarity writing period HWP, is determined. As shown in FIG. 4(B), the average pixel potential VGhwb before the positive polarity writing, becomes higher than the pixel potential VGls of the negative polarity suspension period. Therefore, the potential difference between the average pixel potential VGhwb before the positive polarity writing and the common potential Vcom, becomes larger than the potential difference between the pixel potential VGls of the negative polarity suspension period and the common potential Vcom. Hereby, as shown in FIG. 4(C), at the time of switching to the N+2-th frame period F(N+2) from the N+1-th frame period F(N+1), the sharp change in luminance (luminance decrease) is generated. As a result, the flicker is generated.

Moreover, by the operation described above in the positive polarity writing period HWP, the potential difference between the average pixel potential VGhwa after the positive polarity writing and the common potential Vcom, becomes relatively larger than the potential difference between the average pixel potential VGhwb before the positive polarity writing and the common potential Vcom. Therefore, not only the luminance change at the time of switching to the N+2-th frame period F(N+2) from the N+1-th frame period F(N+1), but also the luminance change (luminance increase) before and after the writing in the positive polarity writing period HWP, become relatively large. Hereby, the degrees of flicker further worsen.

Figure 5:
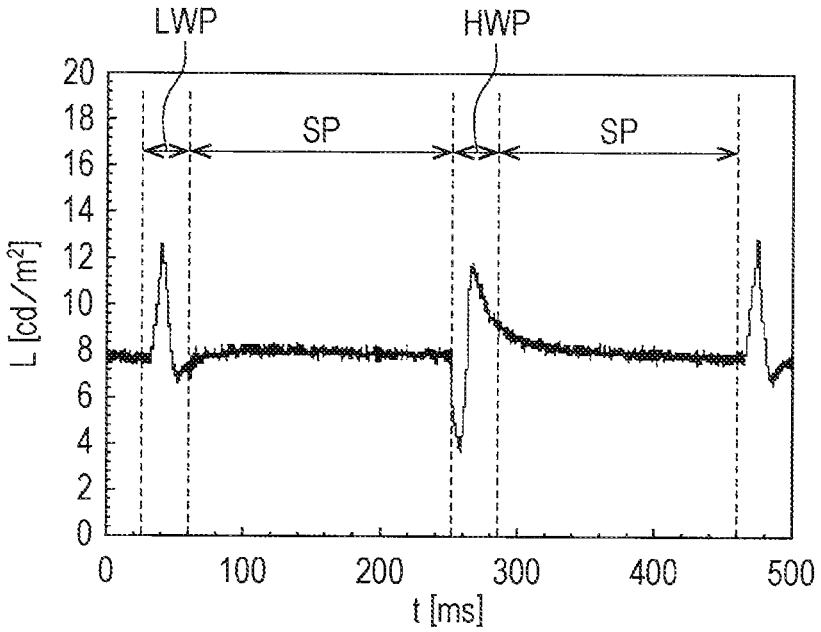
FIG. 5 is a diagram illustrating a simulation result of the display luminance shown in FIG. 4(C).

FIG. 5 is a diagram illustrating a simulation result of the display luminance shown in FIG. 4(C). In FIG. 5, a lateral axis is a time t [ms], and a longitudinal axis is a display luminance L [cd/m$^2$]. As shown in FIG. 5, it is found out that the particularly large flicker is generated at the time of switching of the frame period. The flicker becomes a factor in a lowering of display quality.

As described above, in the related art example, it is found out that the pixel potential greatly varies at the time of switching of the frame period, and thereby, the large flicker is generated. The reason thereof is considered as follows. If the pixel potential greatly varies at the time of switching to the suspension period from each writing period, the difference between the pixel potential in the suspension period and the average pixel potential (average value of the pixel potential which varies depending on an influence of the parasitic capacitance) before the writing in the next writing period, becomes large. Therefore, the pixel potential greatly varies at the time of switching the frame period, and the difference between the display luminance in the suspension period and the display luminance in the writing period of the next frame period, becomes large. Hereby, the large flicker is generated, at the time of switching to the writing period from the suspension period (at the time of switching of the frame period). Accordingly, in the present embodiment, in order to suppress the pixel potential variation at the time of switching the suspension period from each writing period, the voltage (data voltage) of each source line in the suspension period SP, is set to the voltage V_m for suspension period.

In the related art example, as shown in FIG. 4(C), in the positive polarity writing period HWP and the negative polarity writing period LWP, the luminance difference therebetween is mutually generated. The reason thereof is considered as follows. In the related art example, the data voltage in the suspension period SP, becomes 0V which is a voltage out of a gradation voltage range. Therefore, the difference between the data voltage in the positive polarity writing period HWP and the data voltage in the suspension period SP, becomes a dimension which is drastically different from the difference between the data voltage in the negative polarity writing period LWP and the data voltage in the suspension period SP. Hereby, the dimensions in the pixel potential variation at the time of switching to the positive polarity writing period HWP from the suspension period SP, and at the time of switching to the negative polarity writing period LWP from the suspension period SP, are different to each other. Accordingly, in the positive polarity writing period HWP and the negative polarity writing period LWP, the luminance difference therebetween is mutually generated. The setting of the voltage V_m for suspension period is a setting to suppress the luminance difference.

1. 3 Operations

Figure 6:
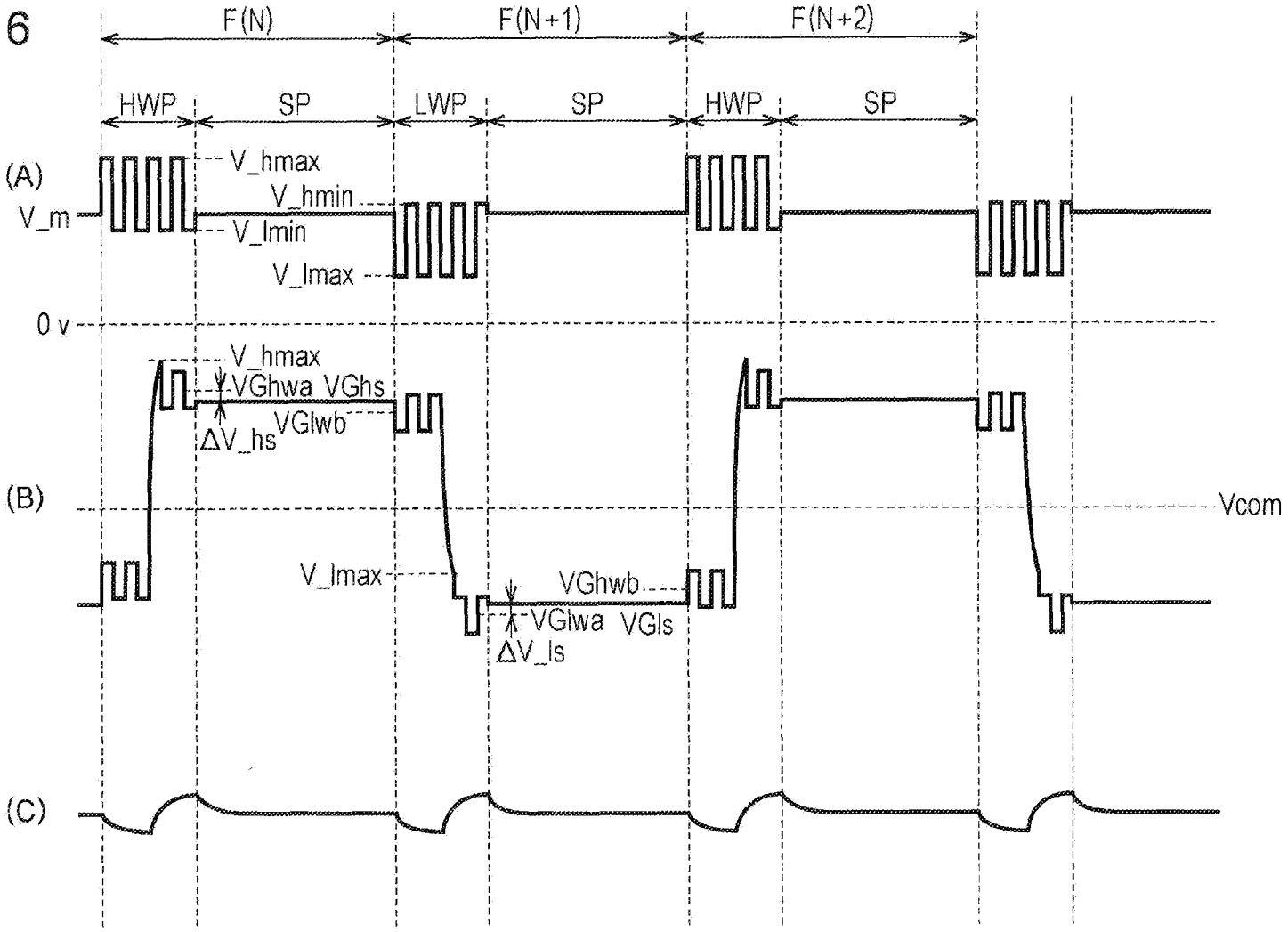
FIG. 6 is a diagram for describing the display luminance which is obtained by the liquid crystal display device according to the first embodiment. (A) is a waveform diagram illustrating the voltage of the source line SLj. (B) is a waveform diagram illustrating the pixel potential in the pixel formation section 110 of the i-th row and the j-th column corresponding to the source line SLj. (C) is a waveform diagram illustrating the display luminance in the pixel formation section 110 of the i-th row and the j-th column.

FIG. 6 is a diagram for describing the display luminance which is obtained by the liquid crystal display device 10 according to the present embodiment. In more detail, FIG. 6(A) is a waveform diagram illustrating the voltage (data voltage) of the source line SLj, FIG. 6(B) is a waveform diagram illustrating the pixel potential in the pixel formation section 110 of the i-th row and the j-th column corresponding to the source line SLj, and FIG. 6(C) is a waveform diagram illustrating the display luminance in the pixel formation section 110 of the i-th row and the j-th column. In FIG. 6(A) to FIG. 6(C), it is assumed that the flicker patterns which are shown in FIG. 3(A) to FIG. 3(C), are displayed, in the same manner as FIG. 4(A) to FIG. 4(C). The display luminance which is shown in FIG. 6(C), is changed depending on the potential difference between the pixel potential shown in FIG. 6(B) and the common potential Vcom. Furthermore, the value of the common potential Vcom shown in FIG. 6(B), is a simple illustration, and is not limited to the value. In addition, the description of portions (particularly, the operations in each writing period) which are common to the operations of the liquid crystal display device of the related art, will be appropriately omitted. As described above, the length of each frame period is 200 ms, the length of the writing period is 16.7 ms, and the length of the suspension period is 183.3 ms. That is, the refresh rate is 5 Hz. Furthermore, if the suspension period SP has the length of each writing period or more, it is favorable, and the length of each period and the refresh rate are not limited to the examples shown here.

The operations in the positive polarity writing period HWP of the N-th frame period F(N), are as described above, and the average pixel potential VGhwa after the positive polarity writing, is given by the above equation (4).

In the present embodiment, the voltage of each source line in the suspension period SP, becomes the voltage V_m for suspension period. Hence, as shown in FIG. 6(A), at the time of switching to the suspension period SP from the positive polarity writing period HWP, the voltages of the source line SLj of the j-th column and the source line SLj+1 of the j+1-th column, are changed to the voltage V_m for suspension period, respectively. Here, the value of the voltage V_m for suspension period is a value within the range where the maximum gradation positive polarity voltage V_hmax is an upper limit, and the maximum gradation negative polarity voltage V_lmax is a lower limit. Preferably, the voltage V_m for suspension period may be a subsequent value of any one of a first voltage for suspension period to a fourth voltage for suspension period.

The first voltage for suspension period, is given by the following equation (9).

$$V_m=(V_h\max+V_l\max+V_h\min+V_l\min)/4 \quad (9)$$

The second voltage for suspension period, is given by the following equation (10).

$$V_m=(V_h\max+V_l\max)/2 \quad (10)$$

The third voltage for suspension period, is given by the following equation (11).

$$V_m=(V_h\min+V_l\min)/2 \quad (11)$$

The fourth voltage for suspension period, is a value within the range where the minimum gradation positive polarity voltage V_hmin is the upper limit, and the minimum gradation negative polarity voltage V_lmin is the lower limit.

By setting the voltage of each source line in the suspension period SP to the voltage V_m for suspension period, in comparison with the related art example in which the voltage of each source line in the suspension period SP is set to 0V, the potential variation in each of the source line SLj of the j-th column and the source line SLj+1 of the j+1-th column at the time of switching to the suspension period SP from the positive polarity writing period HWP, becomes small. Therefore, in the present embodiment, the pixel potential variation ΔV_hs at the time of switching to the suspension period SP from the positive polarity writing period HWP, becomes small in comparison with the related art example. Specifically, the pixel potential variation ΔV_hs at the time of switching to the suspension period SP from the positive polarity writing period HWP in the present embodiment, is given by the following equation (12).

$$\Delta V_hs=[(Csa/\Sigma C)[(V_h\max+V_l\min)/2-V_m]+(Csb/\Sigma C)[(V_h\max+V_l\min)/2-V_m]]/2 \quad (12)$$

Hereby, the pixel potential VGhs of the positive polarity suspension period in the present embodiment, becomes a value which is close to the average pixel potential VGhwa after the positive polarity writing, in comparison with the related art example.

As shown in FIG. 6(A), at the time of switching to the negative polarity writing period LWP from the suspension period SP (at the time of switching to the N+1-th frame period F(N+1) from the N-th frame period F(N)), the voltage of the source line SLj of the j-th column, is changed to the maximum gradation negative polarity voltage V_lmax from the voltage V_m for suspension period. Moreover, the source line SLj+1 of the +1-th column, is changed to the minimum gradation positive polarity voltage V_hmin from the voltage V_m for suspension period (not shown). Therefore, in comparison with the related art example in which the voltage of each source line in the suspension period SP is set to 0V, the potential variation in each of the source line SLj of the j-th column and the source line SLj+1 of the j+1-th column at the time of switching to the negative polarity writing period LWP from the suspension period SP, becomes small. Hereby, the pixel potential variation at the time of transiting to the negative polarity writing period in the present embodiment, becomes small in comparison with the related art example.

The operations in the negative polarity writing period LWP of the N+1-th frame period F(N+1), are as described above, and the average pixel potential VGlwb before the negative polarity writing, is determined by the pixel potential variation at the time of transiting to the negative polarity writing period, and the pixel potential variation before the negative polarity writing. Since the pixel potential variation at the time of transiting to the negative polarity writing period in the present embodiment, is as described above and becomes small in comparison with the related art example, the average pixel potential VGlwb before the negative polarity writing in the present embodiment, becomes a value which is close to the pixel potential VGhs of the positive polarity suspension period, in comparison with the related art example. Therefore, the potential difference between the average pixel potential VGlwb before the negative polarity writing in the present embodiment and the common potential Vcom, and the potential difference between the pixel potential VGhs of the positive polarity suspension period and the common potential Vcom, become the close dimensions to each other in comparison with the related art example. Hereby, as shown in FIG. 6(C), the luminance change at the time of switching to the N+1-th frame period F(N+1) from the N-th frame period F(N) in the present embodiment, become small in comparison with the related art example. As a result, the flicker is suppressed in comparison with the related art example. Furthermore, differently from the related art example, the display luminance at the time of switching to the N+1-th frame period F(N+1) from the N-th frame period F(N) in the present embodiment, is changed into a lowering direction.

The average pixel potential VGlwa after the negative polarity writing, is given by the above equation (4) in the same manner as the related art example. In the present embodiment, since the pixel potential variation at the time of transiting to the negative polarity writing period as described above, becomes small in comparison with the related art example, the potential difference between the average pixel potential VGlwb before the negative polarity writing and the common potential Vcom, and the potential difference between the average pixel potential VGlwa after the negative polarity writing and the common potential Vcom, become the close dimensions to each other in comparison with the related art example. Therefore, in the present embodiment, not only the luminance change at the time of switching to the N+1-th frame period F(N+1) from the N-th frame period F(N), but also the luminance change before and after the writing in the negative polarity writing period LWP, become small in comparison with the related art example. Hereby, the flicker in the negative polarity writing period LWP is sufficiently suppressed.

As shown in FIG. 6(A), at the time of switching to the suspension period SP from the negative polarity writing period LWP, each voltage of the source line SLj of the j-th column and the source line SLj+1 of the j+1-th column, is changed to the voltage V_m for suspension period. Therefore, in comparison with the related art example in which the voltage of each source line in the suspension period SP is set to 0V, the potential variation in each of the source line SLj of the j-th column and the source line SLj+1 of the j+1-th column at the time of switching to the suspension period SP from the negative polarity writing period LWP, becomes small. Hereby, in the present embodiment, the pixel potential variation ΔV_ls at the time of switching to the suspension period SP from the negative polarity writing period LWP, becomes small in comparison with the related art example. Specifically, in the present embodiment, the pixel potential variation ΔV_ls at the time of switching to the suspension period SP from the negative polarity writing period LWP, is given by the following equation (13).

$$\Delta V_ls=[(Csa/\Sigma C)[(V_l\max+V_h\min)/2-V_m]+(Csb/\Sigma C)[(V_l\max+V_h\min)/2-V_m]]/2 \quad (13)$$

Hereby, the pixel potential VGls of the negative polarity suspension period in the present embodiment, becomes a value which is close to the average pixel potential VGlwa after the negative polarity writing, in comparison with the related art example. Furthermore, when any one of the first voltage for suspension period to the fourth voltage for suspension period is used, ΔV_hs and ΔV_ls become the different signs to each other, typically. However, note the case where ΔV_hs and ΔV_ls becomes the same signs to each other by the settings or the like of the maximum gradation positive polarity voltage V_hmax, the maximum gradation negative polarity voltage V_lmax, the minimum gradation positive polarity voltage V_hmin, and the minimum gradation negative polarity voltage V_lmin.

As shown in FIG. 6(A), at the time of switching to the positive polarity writing period HWP from the suspension period SP (at the time of switching to the N+2-th frame period F(N+2) from the N+1-th frame period F(N+1)), the voltage of the source line SLj of the j-th column, is changed to the maximum gradation positive polarity voltage V_hmax from the voltage V_m for suspension period. Moreover, the source line SLj+1 of the j+1-th column, is changed to the minimum gradation negative polarity voltage V_lmin from the voltage V_m for suspension period (not shown). Therefore, in comparison with the related art example in which the voltage of each source line in the suspension period SP is set to 0V, the potential variation in each of the source line SLj of the j-th column and the source line SLj+1 of the j+1-th column at the time of switching to the positive polarity writing period HWP from the suspension period SP, becomes small. Hereby, the pixel potential variation at the time of transiting to the positive polarity writing period in the present embodiment, becomes small in comparison with the related art example.

The operations in the positive polarity writing period HWP of the N+2-th frame period F(N+2), are as described above, and the average pixel potential VGhwb before the positive polarity writing, is determined by the pixel potential variation at the time of transiting to the positive polarity writing period, and the pixel potential variation before the positive polarity writing. Since the pixel potential variation at the time of transiting to the positive polarity writing period in the present embodiment, is as described above and becomes small in comparison with the related art example, the average pixel potential VGhwb before the positive polarity writing in the present embodiment, becomes a value which is close to the pixel potential VGls of the negative polarity suspension period, in comparison with the related art example. Therefore, the potential difference between the average pixel potential VGhwb before the positive polarity writing in the present embodiment and the common potential Vcom, and the potential difference between the pixel potential VGls of the negative polarity suspension period and the common potential Vcom, become the close dimensions to each other in comparison with the related art example. Hereby, as shown in FIG. 6(C), the luminance change at the time of switching to the N+2-th frame period F(N+2) from the N+1-th frame period F(N+1) in the present embodiment, become small in comparison with the related art example. As a result, the flicker is suppressed in comparison with the related art example. Furthermore, in the present embodiment, the display luminance at the time of switching to the N+2-th frame period F(N+2) from the N+1-th frame period F(N+1) in the present embodiment, and the display luminance at the time of switching to the N+1-th frame period F(N+1) from the N-th frame period F(N), are changed into the same direction (lowering direction) to each other.

The average pixel potential VGlwa after the positive polarity writing, is given by the above equation (4) as described above. In the present embodiment, since the pixel potential variation at the time of transiting to the positive polarity writing period as described above, becomes small in comparison with the related art example, the potential difference between the average pixel potential VGhwb before the positive polarity writing and the common potential Vcom, and the potential difference between the average pixel potential VGhwa after the positive polarity writing and the common potential Vcom, become the close dimensions to each other in comparison with the related art example. Therefore, in the present embodiment, not only the luminance change at the time of switching to the N+2-th frame period F(N+2) from the N+1-th frame period F(N+1), but also the luminance change before and after the writing in the positive polarity writing period HWP, become small in comparison with the related art example. Hereby, the flicker in the positive polarity writing period HWP is sufficiently suppressed.

Figure 7:
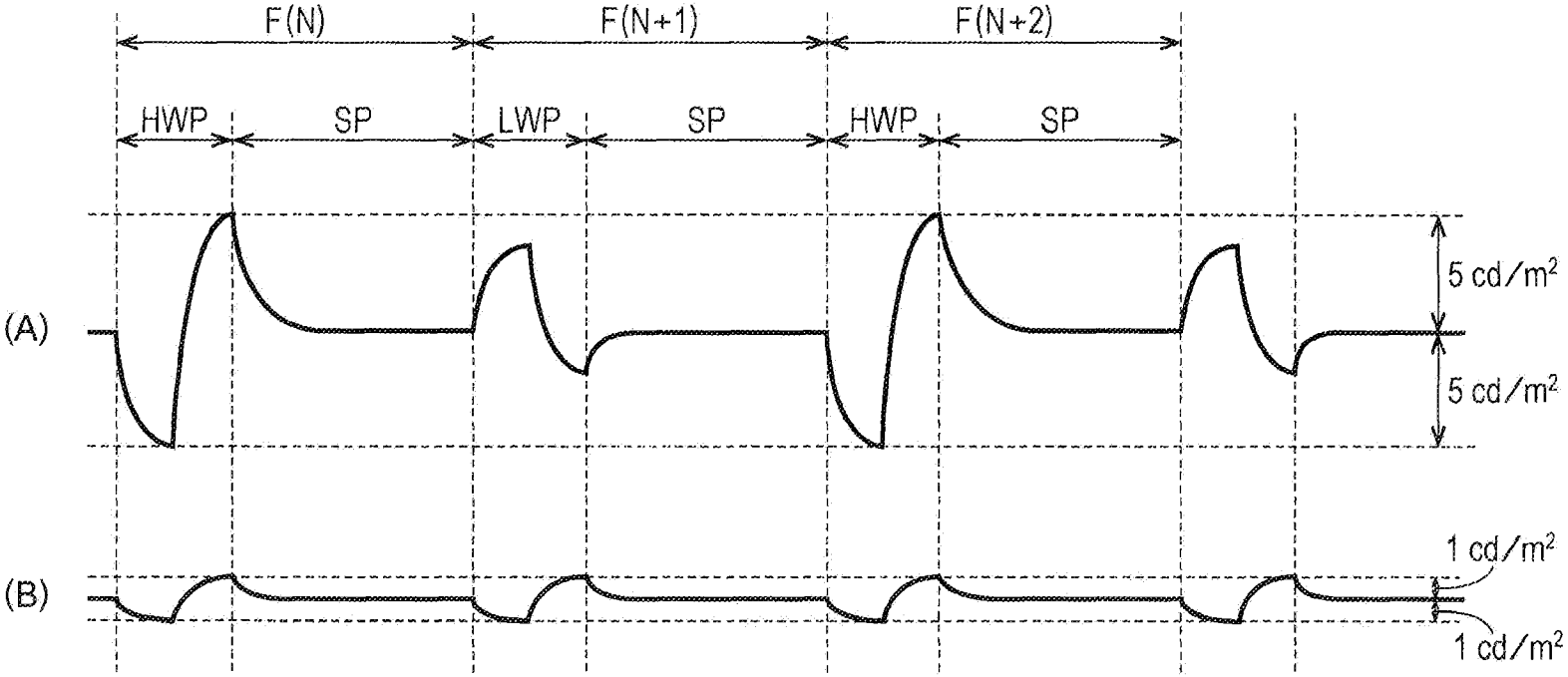
FIG. 7 is a diagram comparing the display luminance which is obtained by the liquid crystal display device according to the related art example, with the display luminance which is obtained by the liquid crystal display device according to the first embodiment. (A) is a diagram illustrating the display luminance which is obtained by the liquid crystal display device according to the related art example. (B) is a diagram illustrating the display luminance which is obtained by the liquid crystal display device according to the first embodiment.

FIG. 7 is a diagram comparing the display luminance which is obtained by the liquid crystal display device according to the related art example, with the display luminance which is obtained by the liquid crystal display device 10 according to the present embodiment. In more detail, FIG. 7(A) is a diagram illustrating the display luminance which is obtained by the liquid crystal display device according to the related art example. FIG. 7(B) is a diagram illustrating the display luminance which is obtained by the liquid crystal display device 10 according to the present embodiment. Furthermore, FIG. 7(A) and FIG. 7(B) correspond to FIG. 4(C) and FIG. 6(C), respectively. As shown in FIG. 7(A) and FIG. 7(B), the flicker of ±5 cd/m$^2$ approximately, is present in the related art example. On the other hand, the flicker is suppressed to ±1 cd/m$^2$ approximately, in the present embodiment.

1. 4 Effects

According to the present embodiment, in the suspension period SP of the low frequency drive mode, the voltage V_m for suspension period is applied to each source line. Therefore, mainly by the presence of the second parasitic capacitance Csa and the third parasitic capacitance Csb, the variation in the pixel potential which is generated at the time of switching to the suspension period SP from each writing period, is as follows. By setting the voltage of the source line in the suspension period SP to the voltage V_m for suspension period, the potential variation in each of the source line SLj of the j-th column and the source line SLj+1 of the j+1-th column at the time of switching to the suspension period SP from the positive polarity writing period HWP, becomes small in comparison with the related art example. Therefore, the pixel potential variation ΔV_hs at the time of switching to the suspension period SP from the positive polarity writing period HWP, becomes small in comparison with the related art example. Hereby, the difference between the display luminance in the suspension period SP and the display luminance in the negative polarity writing period LWP of the next frame period, become small in comparison with the related art example. Accordingly, the flicker which is generated at the time of switching to the frame period including the negative polarity writing period LWP from the frame period including the positive polarity writing period HWP, is suppressed in comparison with the related art example. Moreover, by setting the voltage of the source line in the suspension period SP to the voltage V_m for suspension period, each of the source line SLj of the j-th column and the source line SLj+1 of the j+1-th column at the time of switching to the suspension period SP from the negative polarity writing period LWP, becomes small in comparison with the related art example. Therefore, the pixel potential variation ΔV_ls at the time of switching to the suspension period SP from the negative polarity writing period LWP, becomes small in comparison with the related art example. Hereby, the difference between the display luminance in the suspension period SP and the display luminance in the positive polarity writing period HWP of the next frame period, become small in comparison with the related art example. Accordingly, the flicker which is generated at the time of switching to the frame period including the positive polarity writing period HWP from the frame period including the negative polarity writing period LWP, is also suppressed in comparison with the related art example. In this manner, the lowering of the display quality can be suppressed in comparison with the related art example.

In addition, according to the present embodiment, the difference between the data voltage in the positive polarity writing period HWP and the data voltage in the suspension period SP, and the difference between the data voltage in the negative polarity writing period LWP and the data voltage in the suspension period SP, become the close dimensions to each other in comparison with the related art example. Hence, the difference between the pixel potential variation at the time of switching to the positive polarity writing period HWP from the suspension period SP and the pixel potential variation at the time of switching to the negative polarity writing period LWP from the suspension period SP, become small in comparison with the related art example, and it is possible to enhance the suppression effect of the lowering in the display quality. Furthermore, by adopting the first voltage for suspension period to the fourth voltage for suspension period, it is possible to sufficiently enhance the effect. That is, the difference between the minimum gradation negative polarity voltage V_lmin and the data voltage in the suspension period SP, become almost the same dimension as the difference between the minimum gradation positive polarity voltage V_hmin and the data voltage in the suspension period SP, and the difference between the minimum gradation negative polarity voltage V_lmin and the data voltage in the suspension period SP, become almost the same dimension as the difference between the minimum gradation positive polarity voltage V_hmin and the data voltage in the suspension period SP. Hereby, the pixel potential variation at the time of switching to the positive polarity writing period HWP from the suspension period SP, and the pixel potential variation at the time of switching to the negative polarity writing period LWP from the suspension period SP, are approximately uniformized. In this manner, it is possible to enhance the suppression effect of the lowering in the display quality.

2. Second Embodiment

2. 1 Operation Outline

The liquid crystal display device 10 according to a second embodiment of the present invention, is configured to be switchable between the low frequency drive mode and the normal drive mode. Furthermore, the basic configuration of the liquid crystal display device 10 according to the present embodiment, is similar to that in the first embodiment, and the same reference signs are attached to the same components as the first embodiment among the components of the present embodiment, and the description thereof will be appropriately omitted. The display control circuit 200 controls the switching between the low frequency drive mode and the normal drive mode. In the low frequency drive mode, the display control circuit 200 repeats the operation in the writing period and the operation in the suspension period described above, as a cycle of 1 frame period. On the other hand, in the normal drive mode, the display control circuit 200 repeats the operation in the writing period described above, as a cycle of 1 frame period. Furthermore, in the normal drive mode, the display control circuit 200 may not output the switching signal SW.

2. 2 Setting of Common Potential in Related Art Example

In the related art example, when the low frequency drive is performed, as described above, since the relatively large potential variation (ΔV_hs, ΔV_ls) is present at the time of switching to the suspension period SP from the writing period, the pixel potential in the suspension period SP, becomes the value which is greatly different from that in the writing period. On the other hand, when the normal drive is performed, the potential variation at the time of switching to the suspension period SP from the writing period, is not present. Therefore, when the related art example enables to switch between the low frequency drive mode and the normal drive mode, the common potential that is suitable for the low frequency drive mode, and the common potential that is suitable for the normal drive mode, become the values which are different to each other. If the common potential of the same value is used in the low frequency drive mode and the normal drive mode, the lowering of the display quality is caused. Furthermore, the switching of the common potential is controlled by, for example, the display control circuit 200.

Figure 8:
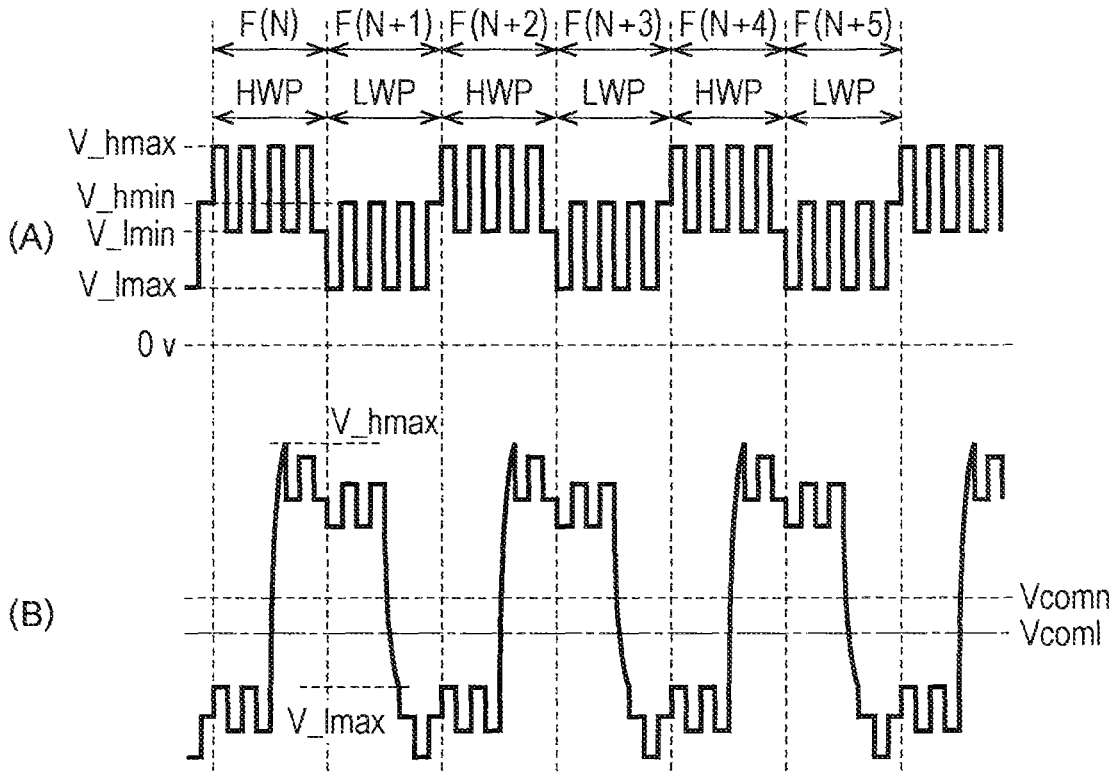
FIG. 8 is a diagram for describing an operation in a normal drive mode of the liquid crystal display device according to the related art example. (A) is a waveform diagram illustrating the voltage of the source line SLj. (B) is a waveform diagram illustrating the pixel potential in the pixel formation section 110 of the i-th row and the j-th column corresponding to the source line SLj.

FIG. 8 is a diagram for describing the operation in the normal drive mode of the liquid crystal display device according to the related art example. In more detail, FIG. 8(A) is a waveform diagram illustrating the voltage (data voltage) of the source line SLj, and FIG. 8(B) is a waveform diagram illustrating the pixel potential in the pixel formation section 110 of the i-th row and the j-th column corresponding to the source line SLj. In FIG. 8(B), the common potential (referred to as "normal common potential," hereinafter) in the normal drive mode is represented by "Vcomn," and the common potential (referred to as "low frequency common potential," hereinafter) in the low frequency drive mode is represented by "Vcoml." Furthermore, the low frequency common potential Vcoml which is shown in FIG. 8(B), is the same value as the common potential Vcom which is shown in FIG. 4(B).

As shown in FIG. 8(A) and FIG. 8(B), each frame period includes the writing periods, and the positive polarity writing period HWP and the negative polarity writing period LWP are sequentially repeated per 1 frame period. In the normal drive mode, since the suspension period SP is not included in each frame period, the potential variation at the time of switching to the suspension period SP from the writing period, is not present. In the normal drive mode described above, the normal common potential Vcomn is set to, for example, the following equation (14).

$$\begin{aligned} Vcomn &= [(\mathrm{V_hmax} - \Delta Vgd) + (\mathrm{V_lmax} - \Delta Vgd)]/2 \\ &= (\mathrm{V_hmax} + \mathrm{V_lmax})/2 - \Delta Vgd \end{aligned} \tag{14}$$

Incidentally, when the low frequency common potential Vcoml is set in the low frequency drive mode, in addition to the pixel potential variation ΔV_hs at the time of switching to the suspension period SP from the positive polarity writing period HWP, and the pixel potential variation ΔV_ls at the time of switching to the suspension period SP from the negative polarity writing period LWP, it is preferable that the length of the suspension period SP (hereinafter, the sign SP itself may also represent the length of the suspension period SP) is also considered. This comes from the reason that the off-leak current slightly flows even when the oxide TFT is used as TFT 111, and the pixel potential variation is different depending on the length of the suspension period SP. Therefore, a difference ΔVmod between the normal common potential Vcomn and the low frequency common potential Vcoml, is given by the following equation (15).

$$\Delta V\,\mathrm{mod} = (Vcomn - Vcomlw)(WP/F) + (Vcomn - Vcomls)(SP/F) \tag{15}$$

Here, Vcomlw, and Vcomls represent the low frequency common potential in the writing period, and the low frequency common potential in the suspension period SP, respectively. WP represents the length of the writing period, and F represents the length of 1 frame period. Furthermore, in the writing period of the normal drive mode and the writing period of the low frequency drive mode, only drive frequencies are different to each other, and the field through voltage ΔVgd becomes the same value to each other. Therefore, the equation (15) is rewritten to the following equation (16).

$$\Delta V\,\mathrm{mod} = (Vcomn - Vcomls)(SP/F) \tag{16}$$

"Vcomn−Vcomls" in the equation (16), is given by the following equation (17).

$$Vcomn - Vcomls = (\Delta V_hs + \Delta V_ls)/2 \tag{17}$$

Here, since ΔV_hs is given by the above equation (5), and ΔV_ls is given by the above equation (7), the equation (17) is rewritten to the following equation (18).

$$\begin{aligned} Vcomn - Vcomls &= [(Csa/2\Sigma C)(\mathrm{V_hmax} + \mathrm{V_lmax} + \mathrm{V_hmin} + \mathrm{V_lmin}) + (Csb/2\Sigma C)(\mathrm{V_hmax} + \mathrm{V_lmax} + \mathrm{V_hmin} + \mathrm{V_lmin})]/2 \\ &= (\mathrm{V_hmax} + \mathrm{V_lmax} + \mathrm{V_hmin} + \mathrm{V_lmin})(Csa + Csb)/4\Sigma C \end{aligned} \tag{18}$$

By the equation (16) and the equation (18), the difference ΔVmod between the normal common potential Vcomn and the low frequency common potential Vcoml, is given by the following equation (19).

$$\Delta V\,\mathrm{mod} = (V_h\mathrm{max} + V_l\mathrm{max} + V_h\mathrm{min} + V_l\mathrm{min})(Csa + Csb)(SP/F)/4\Sigma C \tag{19}$$

As shown in the equation (19), since ΔVmod is not 0, in the related art example, it is necessary that the normal common potential Vcomn and the low frequency common potential Vcoml are set to be the different values to each other. In this case, the circuit configuration becomes complicated in comparison with the case of using single common potential.

2. 3 Setting of Common Potential in Second Embodiment

Figure 9:
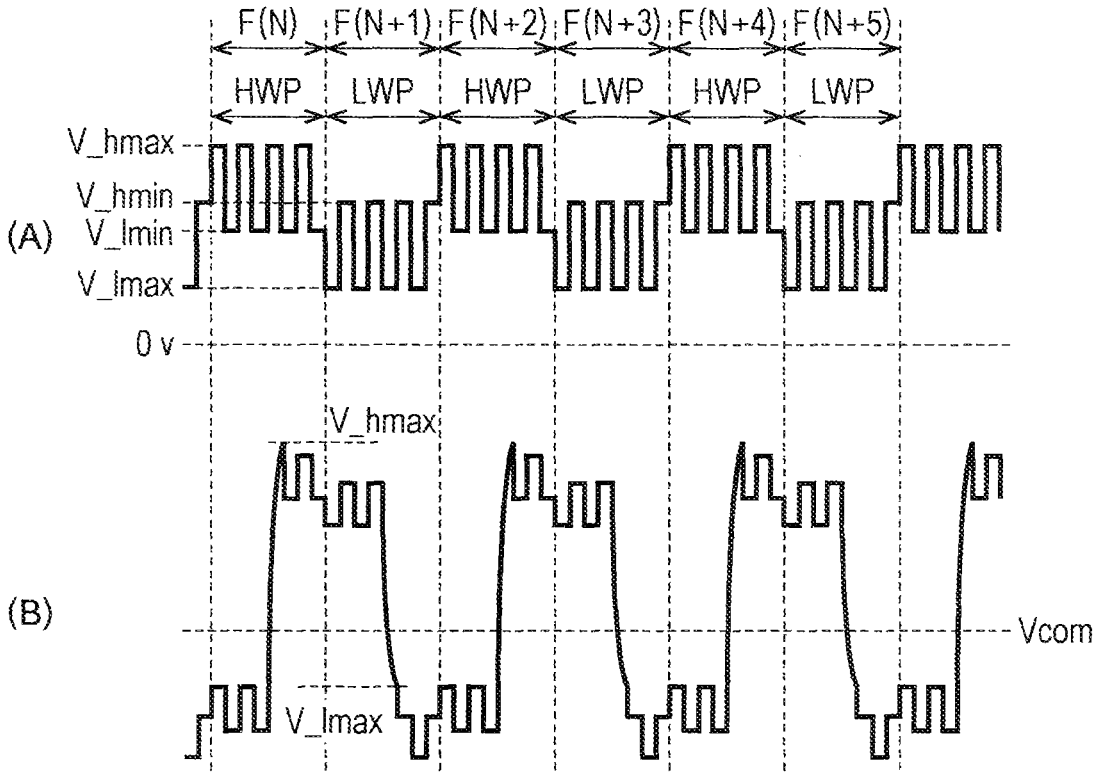
FIG. 9 is a diagram for describing an operation in a normal drive mode of a liquid crystal display device according to a second embodiment of the present invention. (A) is a waveform diagram illustrating the voltage of the source line SLj. (B) is a waveform diagram illustrating the pixel potential in the pixel formation section 110 of the i-th row and the j-th column corresponding to the source line SLj.

FIG. 9 is a diagram for describing the operation in the normal drive mode of the liquid crystal display device 10 according to the present embodiment. In more detail, FIG. 9(A) is a waveform diagram illustrating the voltage (data voltage) of the source line SLj, and FIG. 9(B) is a waveform diagram illustrating the pixel potential in the pixel formation section 110 of the i-th row and the j-th column corresponding to the source line SLj. As shown in FIG. 9(A) and FIG. 9(B), each of the waveform showing the voltage of the source line SLj and the waveform showing the pixel potential in the pixel formation section 110 of the i-th row and the j-th column corresponding to the source line SLj in the present embodiment, is the same as those in the related art example. However, as shown in FIG. 9(B), in the present embodiment, the common potential Vcom which is the same value to each other, is used in both of the low frequency drive mode and the normal drive mode. Furthermore, the operation of the low frequency drive mode in the present embodiment, is the same as that in the first embodiment.

In the present embodiment, it is assumed that the first voltage for suspension period is used as the voltage V_m for suspension period. Since ΔV_hs is given by the above equation (12), and ΔV_ls is given by the above equation (13), the above equation (17) is rewritten to the following equation (20).

$$Vcomn - Vcomls = [(Csa/2\Sigma C)[(V_hmax + V_lmax + V_hmin + V_lmin) - 4V_m] + (Csa/2\Sigma C)[(V_hmax + V_lmax + V_hmin + V_lmin) - 4V_m]/2 = (V_hmax + V_lmax + V_hmin + V_lmin - 4V_m)(Csa + Csb)/4\Sigma C \quad (20)$$

As described above, since the voltage V_m suspension period is the first voltage for suspension period, if V_m which is given by the above equation (9), is substituted into the equation (20), "Vcomn−Vcomls" becomes 0. As a result, ΔVmos also becomes 0. That is, it is possible to set the common potential to the same value (Vcom which is shown in FIG. 9(B)) in the low frequency drive mode and the normal drive mode.

2. 4 Effects

According to the present embodiment, in the liquid crystal display device 10 which enables to switch between the low frequency drive mode and the normal drive mode, since the common potential becomes the same value in the low frequency drive mode and the normal drive mode, it is not necessary that the common potential is switched depending on the switching the drive mode. Therefore, it is possible to suppress the lowering of the display quality in the simple configuration.

Furthermore, the first voltage for suspension period is used as the voltage V_m for suspension period in the above description, but the present invention is not limited thereto. Also in the voltage V_m for suspension period other than the first voltage for suspension period, ΔVmod is small in comparison with the related art example (see the equations (16) and (20)). Hence, even if the common potential is the same value in the low frequency drive mode and the normal drive mode, the lowering of the display quality when the common potential is the same value as in the low frequency drive mode and the normal drive mode in the related art example, is suppressed.

3. Third Embodiment

3. 1 Configuration of Source Driver

Figure 10:
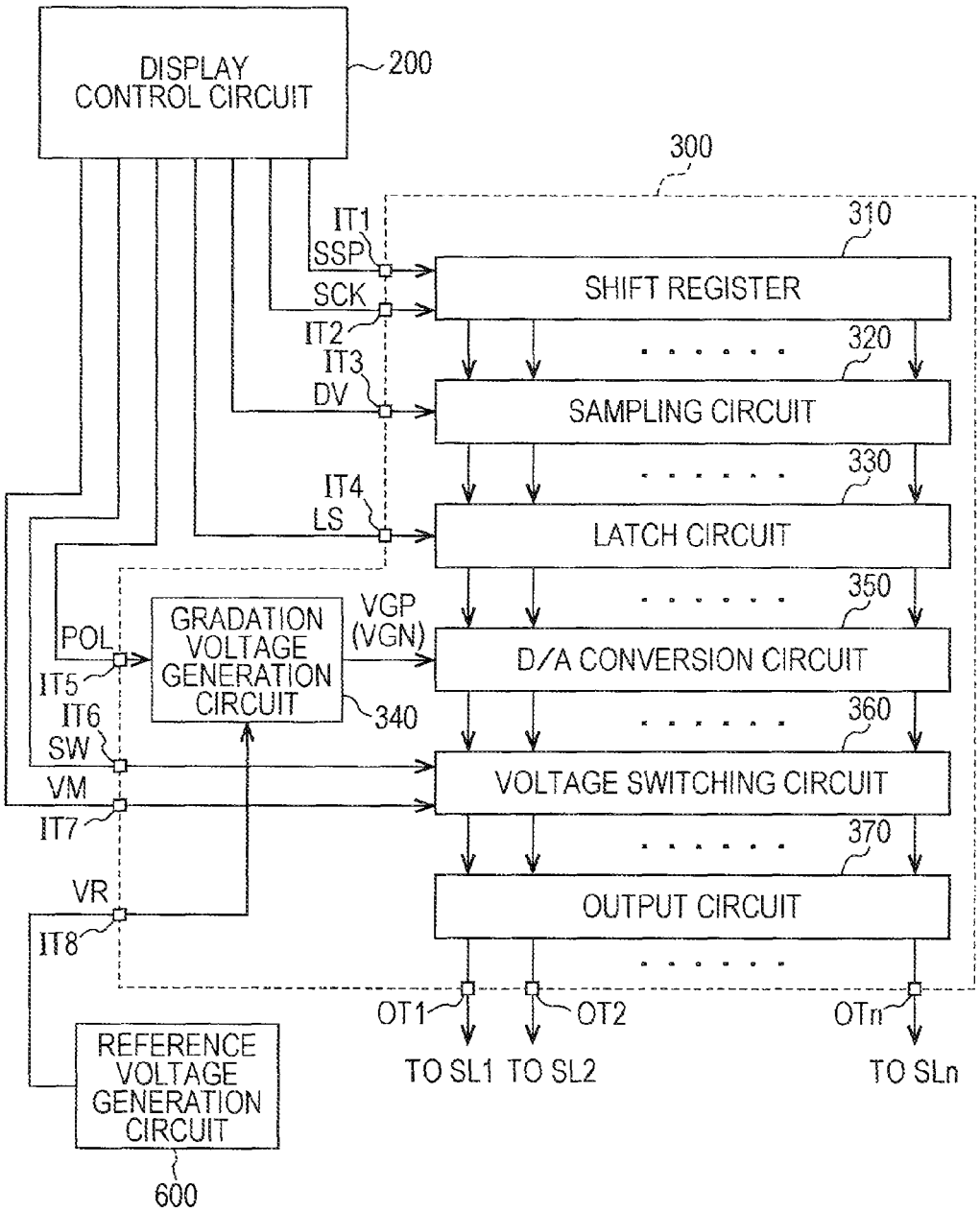
FIG. 10 is a block diagram for describing a configuration of a source driver in a third embodiment of the present invention.

FIG. 10 is a block diagram for describing the configuration of the source driver 300 in a third embodiment of the present invention. The liquid crystal display device 10 according to the present embodiment, is configured so as to supply a voltage signal VM for suspension period indicating the voltage V_m for suspension period, to the source driver 300 from the display control circuit 200. Furthermore, since other configurations are similar to those in the first embodiment, the description thereof will be omitted. The present embodiment may use in combination with any one of the first embodiment and the second embodiment.

The display control circuit 200 outputs the digital video signal DV, the source start pulse SSP, the source clock SCK, the latch strobe signal LS, the polarity signal POL, the switching signal SW, the gate start pulse GSP, the gate clock GCK, and the voltage signal VM for suspension period, to the source driver 300. The reference voltage generation circuit 600 outputs the plurality of reference signals VR to the source driver 300.

The source driver 300 includes a first input terminal IT1 to an eighth input terminal IT8, a first output terminal OT1 to a m-th output terminal OTn, a shift register 310, a sampling circuit 320, a latch circuit 330, a gradation voltage generation circuit 340, a D/A conversion circuit 350, a voltage switching circuit 360, and an output circuit 370. In the present embodiment, the first terminal is realized by the seventh input terminal IT7, and the second terminal is realized by the sixth input terminal IT6.

The first input terminal IT1 is a terminal for receiving the source start pulse SSP. The second input terminal IT2 is a terminal for receiving the source clock SCK. The third input terminal IT3 is a terminal for receiving the digital video signal DV. The fourth input terminal IT4 is a terminal for receiving the latch strobe signal LS. The fifth input terminal IT5 is a terminal for receiving the polarity signal POL. The sixth input terminal IT6 is a terminal for receiving the switching signal SW. The seventh input terminal is a terminal for receiving the voltage signal VM for suspension period. The eighth input terminal IT8 is a terminal for receiving the reference voltage signal VR. Furthermore, when the digital video signal DV is transmitted in parallel, the plurality of third input terminals IT3 are arranged. Moreover, the eighth input terminals IT8 are actually arranged by the same number as the number of the reference voltage signals VR, but for convenience, one of the eighth input terminal IT8 is shown in the drawing. The first output terminal OT1 to the m-th output terminal OTn, are terminals for outputting the data voltage to the source lines SL1 to SLn, respectively.

The shift register 310 synchronizes with the source start pulse SSP that is output from the display control circuit 200, and sequentially outputs a predetermined sampling pulse by sequentially transferring the source start pulse SSP which is output from the display control circuit 200.

The sampling circuit 320 sequentially stores the gradation value of 1 row shown in the digital video signal DV which is output from the display control circuit 200, at the timing of the sampling pulse.

The latch circuit 330 captures and retains the gradation value of 1 row which is stored in the sampling circuit 320, depending on the latch strobe signal LS which is output from the display control circuit 200, and outputs the retained gradation value of 1 row, to the D/A conversion circuit 350 per 1 column (that is, per 1 pixel). Furthermore, a gradation signal which is output from the latch circuit 330, is actually given to the D/A conversion circuit 350 after being boosted by a predetermined level shifter, but here, the description thereof is omitted for convenience.

Based on the plurality of reference voltages VR which are output from the reference voltage generation circuit 600, and the polarity signal POL which is output from the display control circuit 200, the gradation voltage generation circuit 340 generates the plurality of gradation voltages depending on the polarity, and outputs the plurality of gradation voltages, to the D/A conversion circuit 350. Furthermore, when the dot reversal drive or the like is performed, the polarity signal POL shows the different polarity per 1 column.

The D/A conversion circuit 350 selects the gradation voltage among the plurality of gradation voltages which are output from the gradation voltage generation circuit 340, depending on the gradation value per 1 column, and outputs the selected gradation voltage, to the voltage switching circuit 360.

Based on the switching signal SW which is output from the display control circuit 200, the voltage switching circuit 360 switches the voltage to be output, to the output circuit 370. Specifically, in the writing signal, the voltage switching circuit 360 outputs the gradation voltage (data voltage) per 1 column which is output from the D/A conversion circuit 350, to the output circuit 370. Moreover, in the suspension period, the voltage switching circuit 360 outputs the voltage V_m (data voltage) for suspension period shown in the voltage signal VM for suspension period which is output from the display control circuit 200, per 1 column, to the output circuit 370. In this manner, on the basis of the switching signal SW, when the polarity of the data signal is the positive polarity or the negative polarity, the voltage switching circuit 360 is configured so as to set any one of the plurality of positive polarity gradation voltages, or any one of the plurality of negative polarity gradation voltages, to a data voltage, in the writing period, and the voltage switching circuit 360 is configured so as to set the voltage V_m for suspension period which is shown in the voltage signal VM for suspension period, to a data voltage, in the suspension period. Furthermore, it is not necessary that the voltage itself of the voltage signal VM for suspension period, is the voltage V_m for suspension period, and if the voltage V_m for suspension period may be obtained by carrying out to a predetermined conversion processing of the voltage switching circuit 360 with respect to the voltage signal VM for suspension period, it is favorable.

The output circuit 370 applies the gradation voltage per 1 column which is output from the voltage switching circuit 360, or the voltage V_m for suspension period, to each of the corresponding source lines SL1 to SLn. The output circuit 370 is configured by, for example, n voltage follower circuits.

The configuration of the source driver 300 which is shown here, is only one example. The source driver 300 includes at least the sixth terminal IT6, and the seventh input terminal IT7, and enables to switch the data voltage to be applied to each source line in the writing period and the suspension period, on the basis of the switching signal SW which is received through the sixth input terminal IT6. Moreover, if the voltage V_m for suspension period shown in the voltage signal VM for suspension period which is received from the seventh terminal IT7 in the suspension period, become applicable to each source line, it may be in any other configurations.

3. 2 Effects

According to the present embodiment, using the source driver 300 including the sixth terminal IT6, the seventh terminal IT7, and the voltage switching circuit 360, it is possible to have the same effects as the first embodiment or the second embodiment.

4. Others

In each embodiment described above, the case of adopting the normally black mode, is described, but a normally white mode may be adopted. In this case, in the description described above, by replacing the maximum gradation positive polarity voltage V_hmax with the minimum gradation positive polarity voltage V_hmin, and replacing the maximum gradation negative polarity voltage V_lmax with the minimum gradation negative polarity voltage V_lmin, a similar argument is materialized. Moreover, each of the above embodiments is described exemplifying an example in which the flicker pattern is displayed, but the effects described above are obtained even when other displays are performed. In addition, each of the above embodiments can be carried out in various modifications within a range without departing from the gist of the present invention.

REFERENCE SIGNS LIST

10 liquid crystal display device
100 liquid crystal display section
110 pixel formation section
111 TFT (thin film transistor)
112 pixel electrode
113 common electrode
200 display control circuit
300 source driver (data line drive circuit)
360 voltage switching circuit
400 gate driver (scan line drive circuit)
500 common potential supply circuit
600 reference voltage generation circuit
SLj (j=1 to n) source line (data line)
GLi (i=1 to m) gate line (scan line)
Clc liquid crystal capacitance
Cst subsidiary capacitance
Cgd first parasitic capacitance
Csa second parasitic capacitance
Csb third parasitic capacitance
IT1 to IT8 first to eighth input terminals
OT1 to OTn first to N-th output terminals
POL polarity signal
SW switching signal
V_hmax maximum gradation positive polarity voltage
V_hmin minimum gradation positive polarity voltage
V_lmax maximum gradation negative polarity voltage
V_lmin minimum gradation negative polarity voltage
V_m voltage for suspension period
VM voltage signal for suspension period
F frame period
HWP positive polarity writing period
LWP negative polarity writing period
SP suspension period

The invention claimed is:

1. A liquid crystal display device which enables to drive a liquid crystal display section in a first drive mode in which a writing period where a plurality of scan lines are sequentially selected, and a suspension period having a length of the writing period or more where all of the plurality of scan lines are in a non-selection state, alternately appear in a cycle of a first drive frame period which includes the writing period and the suspension period, the device comprising:

the liquid crystal display section including a plurality of data lines, the plurality of scan lines, a plurality of pixel electrodes that are positioned in a matrix shape to correspond to the plurality of data lines and the plurality of scan lines, and a common electrode that is arranged to correspond to the plurality of pixel electrodes;

a data line drive circuit that sends a data signal to the plurality of pixel electrodes through the plurality of data lines, and reverses polarity of the data signal for the each writing period; and a scan line drive circuit that drives the plurality of scan lines, wherein in the writing period, the data line drive circuit sets any one of a plurality of positive polarity gradation voltages, or any one of a plurality of negative polarity gradation voltages, as a voltage of the data signal, the plurality of positive polarity gradation voltages being associated with a polarity signal having a first value indicating a positive polarity for the writing period, the plurality of negative polarity gradation voltages being associated with a polarity signal having a second value indicating a negative polarity for the writing period, and in the suspension period, the data line drive circuit sets the voltage of the data signal, to an average value of a maximum gradation voltage among the plurality of positive polarity gradation voltages, a maximum gradation voltage among the plurality of negative polarity gradation voltages, a minimum gradation voltage among the plurality of positive polarity gradation voltages, and a minimum gradation voltage among the plurality of negative polarity gradation voltages, and the liquid crystal display section further includes a thin film transistor that includes a channel layer formed by an oxide semiconductor and that is connected to the pixel electrode and the data line corresponding to the pixel electrode.

2. The liquid crystal display device according to claim 1, further comprising:

a display control circuit that controls the data line drive circuit and the scan line drive circuit, and switches between the first drive mode and a second drive mode having a cycle of a second drive frame period which includes the writing period.

3. The liquid crystal display device according to claim 2, further comprising:

a common potential supply circuit that sends a common potential to the common electrode, wherein the common potential supply circuit sets the common voltage to a value that is the same as the values in the first drive mode and the second drive mode.

4. The liquid crystal display device according to claim 1, wherein the data line drive circuit includes a first terminal to receive a voltage signal for suspension period corresponding to the voltage of the data signal in the suspension period, and a second terminal to receive a switching signal indicating the switching between the writing period and the suspension period.

5. The liquid crystal display device according to claim 4, wherein the display control circuit gives the voltage of the data signal for suspension period and the switching signal to the first terminal and the second terminal, respectively.

6. The liquid crystal display device according to claim 1, comprising:

a common potential supply circuit that sends a common potential to the common electrode, wherein the common potential supply circuit sets the common potential to a value that is the same as the values in the writing period and the suspension period.

7. A data line drive circuit which includes a liquid crystal display section including a plurality of data lines, a plurality of scan lines, a plurality of pixel electrodes that are positioned in a matrix shape to correspond to the plurality of data lines and the plurality of scan lines, and a common electrode that is arranged to correspond to the plurality of pixel electrodes, is used in a liquid crystal display device that enables to drive the liquid crystal display section in a first drive mode in which a writing period where the plurality of scan lines are sequentially selected, and a suspension period having a length of the scan period or more where all of the plurality of scan lines are in a non-selection state, alternately appear in a cycle of a first drive frame period which includes the scan period and the suspension period, gives a data signal to the plurality of pixel electrodes through the plurality of data lines, and reverses polarity of the data signal for the each writing period, the circuit comprising:

a first terminal to receive a voltage signal for suspension period corresponding to a voltage of the data signal in the suspension period;

a second terminal to receive a switching signal indicating the switching between the writing period and the suspension period; and a voltage switching circuit that sets any one of a plurality of positive polarity gradation voltages, or any one of a plurality of negative polarity gradation voltages as the voltage of the data signal, in the writing period, and sets the voltage which is shown in the voltage signal for suspension period as the voltage of the data signal, in the suspension period, based on the switching signal, the plurality of positive polarity gradation voltages being associated with a polarity signal having a first value indicating a positive polarity for the writing period, the plurality of negative polarity gradation voltages being associated with a polarity signal having a second value indicating a negative polarity for the writing period, wherein the voltage which is shown in the voltage signal for suspension period, is an average value of a maximum gradation voltage among the plurality of positive polarity gradation voltages, a maximum gradation voltage among the plurality of negative polarity gradation voltages, a minimum gradation voltage among the plurality of positive polarity gradation voltages, and a minimum gradation voltage among the plurality of negative polarity gradation voltages, and the liquid crystal display section further includes a thin film transistor that includes a channel layer formed by an oxide semiconductor and that is connected to the pixel electrode and the data line corresponding to the pixel electrode.

8. A drive method for a liquid crystal display device which includes a liquid crystal display section including a plurality of data lines, a plurality of scan lines, a plurality of pixel electrodes that are positioned in a matrix shape to correspond to the plurality of data lines and the plurality of scan lines, and a common electrode that is arranged to correspond to the plurality of pixel electrodes, and enables to drive the liquid crystal display section in a first drive mode in which a writing period where the plurality of scan lines are sequentially selected, and a suspension period having a length of the scan period or more where all of the plurality of scan lines are in a non-selection state, alternately appear in a cycle of a first drive frame period which includes the scan period and the suspension period, the drive method comprising:

a data line drive step of giving a data signal to the plurality of pixel electrodes through the plurality of data lines, and reversing polarity of the data signal for the each writing period, wherein the data line drive step includes a step of setting in the writing period, any one of a plurality of positive polarity gradation voltages, or any one of a plurality of negative polarity gradation voltages, as a voltage of the data signal, the plurality of positive polarity gradation voltages being associated with a polarity signal having a first value indicating a positive polarity for the writing period, the plurality of negative polarity gradation voltages being associated with a polarity signal having a second value indicating a negative polarity for the writing period, and a step of setting in the suspension period, the voltage of the data signal, to an average value of a maximum gradation voltage among the plurality of positive polarity gradation voltages, a maximum gradation voltage among the plurality of negative polarity gradation voltages, a minimum gradation voltage among the plurality of positive polarity gradation voltages, and a minimum gradation voltage among the plurality of negative polarity gradation voltages, and the liquid crystal display section further includes a thin film transistor that includes a channel layer formed by an oxide semiconductor and that is connected to the pixel electrode and the data line corresponding to the pixel electrode.

* * * * *